US006161359A

United States Patent [19]

Ono

[11] Patent Number: 6,161,359

[45] Date of Patent: Dec. 19, 2000

[54] SHORING

[75] Inventor: Tatsuo Ono, 1-chome, 10-ban, 1-go, Kakigara-cho, Nohonbashi, Chuo-ku, Tokyo, Japan

[73] Assignee: Tatsuo Ono, Tokyo, Japan

[21] Appl. No.: 09/203,030

[22] Filed: Dec. 1, 1998

[30] Foreign Application Priority Data

Dec. 26, 1997 [JP] Japan ..... 9-369453
Apr. 28, 1998 [JP] Japan ..... 10-134421

[51] Int. Cl.[7] ..... E04H 12/00

[52] U.S. Cl. ..... 52/651.1; 52/646; 14/75; 182/152; 182/178.6; 248/150; 248/166

[58] Field of Search ..... 52/646, 651.1; 14/75; 182/152, 178.6; 248/150, 166, 171

[56] References Cited

U.S. PATENT DOCUMENTS 534,274 2/1895 Massau ..... 52/646
2,982,379 5/1961 Fisher ..... 182/152 X
3,650,081 3/1972 McCracken ..... 182/178.6 X
3,835,612 9/1974 Beziat ..... 52/646 X
5,765,248 6/1998 Ono .

FOREIGN PATENT DOCUMENTS 7-8416 2/1995 Japan .
9-31923 2/1997 Japan .

*Primary Examiner*—Beth A. Stephan
*Assistant Examiner*—Brian E. Glessner
*Attorney, Agent, or Firm*—McGlew and Tuttle, P.C.

[57] ABSTRACT

The shoring includes a pair of fixed frames opposed to each other and a pair of collapsible reinforcing frames disposed between both ends of the fixed frames, the reinforcing frames each having collapsible baluster struts whose base ends are pivotally connected between end portions of the fixed frames, a support rod whose base end is pivotally connected to an intermediate position of the baluster struts, and plural braces whose base ends are pivotally connected to end portions of the fixed frames and whose front ends are mounted vertically slidably to the support rod.

15 Claims, 25 Drawing Sheets

SHORING

FIELD OF THE INVENTION

The present invention relates to a shoring for supporting a block of a heavy object such as, for example, a bridge girder or a large truss in a bridge building work or in a construction or civil engineering work.

BACKGROUND OF INVENTION

Generally, in installing a bridge girder on a pier in a bridge building work, a bridge girder block manufactured to an optional size beforehand in a factory is transported up to the building site, then the block is supported temporarily onto a shoring while being suspended with a crane, the block thus temporarily supported is then combined with another like block and thereafter the thus-combined block is installed onto a pier. In this case, after the bridge girder has been installed onto the pier, the shoring is disassembled or removed.

However, assembling and disassembling the shoring in the building site lead to not only deteriorated working efficiency but also deteriorated economy. In view of this point there has recently been developed such a collapsible shoring as is disclosed, for example, in Japanese Utility Model Laid Open No.8416/95. During transport, this collapsible shoring can be folded in a compact shape, while for use in a building site, it is unfolded in a cubic fonn. Thus, it is employable for each building site without the need of assembly and disassembly.

The shoring disclosed in the above unexamined publication comprises a pair of fixed frames opposed to each other, a pair of collapsible reinforcing frames pivotally connected to both right and left ends of the fixed frames, and floor plates whose base ends are pivotally connected rotatably to inside intermediate positions of the fixed frames.

The reinforcing frames each comprise collapsible baluster struts pivotally mounted between the upper ends of struts as constituents of the fixed frames, collapsible horizontal members pivotally mounted between the struts, braces pivotally connected to the upper ends of the struts and to an intermediate position of the horizontal members, and a vertical member mounted between an intermediate position of the baluster struts and an intermediate position of the horizontal members. While in use, the shoring is unfolded in a cubic form, but while not in use, for example during transport, the lower ends of the braces are disengaged from the horizontal member, and the reinforcing frames are folded into a compact shape as a whole when compressed longitudinally by virtue of their own weight.

In the above conventional shoring, however, the reinforcing frames are of a collapsible structure and no reinforcing member is present below the horizontal member, with only two braces being present above. Thus, against vertical and transverse loads, both durability and strength are ensured in the presence of the fixed frames and there is no fear of deformation, but there is weakness against longitudinal loads, for example, against vibrations and it is likely that there may occur deformation in the direction of compression. Further, for folding in a compact shape, it is necessary to take the trouble of disconnecting the lower ends of the braces from the fulcrum of the horizontal member. Thus, the working efficiency is deteriorated markedly.

In view of the above-mentioned point the present inventor has previously developed a shoring having durability against not only vertical and transverse loads but also longitudinal loads and capable of being folded automatically without the need of any extra work.

The said shoring, as disclosed in Japanese Patent Laid Open No.31923/97, comprises a pair of fixed frames opposed to each other, a pair of collapsible reinforcing frames disposed between both ends of the fixed frames, and floor plates whose base ends are pivotally secured to inside intermediate positions of the fixed frames. The reinforcing frames each comprise collapsible baluster struts whose base ends are pivotally secured to the upper ends of the fixed frames, four expansible/retractable braces whose base ends are pivotally connected to upper and lower ends of the fixed frames which extend obliquely toward an inside middle position, a support member comprising a flange for pivotal connection with the front ends of the braces and a guide cylinder provided on the back of the flange, a support rod whose base end is fixed to an intermediate position of the baluster struts and whose lower end is fixed or inserted slidably and selectively into the guide cylinder, and a bracket mounted at the lower end of the support rod to rotatably connect therewith the front ends of the floor plates.

The above shoring is superior in both strength and function, but is desired to be improved in the following points.

The four braces are each of an expansible/retractable mechanism comprising an outer tube and an inner tube. The front ends of the four braces are gathered and connected to a strong flange. The flange is provided with a guide cylinder, into which the support rod is inserted slidably. Thus, the structure is complicated and this complicated structure results in an increase of both manufacturing cost and weight. Therefore, when the shoring is folded or when it is restored to its cubic state from the folded state, the associated work is difficult and so is the work for transport.

SUMMARY OF THE INVENTION

It is therefore an object of the present invention to provide a shoring of a simple structure and light weight and capable of reducing the manufacturing cost, improving the working efficiency in both folding work and transport work.

In order to achieve the above-mentioned object, in one aspect of the present invention there is provided a shoring comprising a pair of fixed frames opposed to each other and a pair of collapsible reinforcing frames disposed between both ends of the fixed frames, the reinforcing frames each comprising collapsible baluster struts whose base ends are pivotally secured between end portions of the fixed frames, a support rod whose base end is pivotally secured to an intermediate position of the baluster struts and which is suspended downward, and four braces pivotally secured at base ends thereof to upper and lower ends of the fixed frames and attached at their front ends to the support rod vertically movably.

Vertically, one or plural reinforcing frames are disposed between both ends of the paired fixed frames.

Plural reinforcing frames may be disposed vertically between both ends of the fixed frames and a support rod which constitutes the reinforcing frames may be formed integrally.

There may be provided a horizontal brace means, the horizontal brace means comprising reinforcing braces which cross in an X shape and sockets of an inverted U shape formed at end portions of the reinforcing braces. The horizontal brace means may be hooked to the upper ends of the fixed frames detachably through the sockets.

Sockets may be formed at the upper ends of the fixed frames and another rectangularly parallelepipedic or cubic auxiliary shoring unit may be mounted contiguously above the fixed frames and the reinforcing frames through the sockets.

Sockets may be formed at the lower ends of the fixed frames and another rectangularly parallelepipedic or cubic auxiliary shoring unit may be mounted contiguously below the fixed frames and the reinforcing frames. Further, jacks capable of being adjusted in their height may be connected to lower comers of the said auxiliary shoring unit and reinforcing braces may be disposed between the jacks.

Scaffolding boards projecting horizontally may be attached detachably to the outer periphery of the auxiliary shoring unit mounted contiguously above both fixed frames and reinforcing frames.

Brackets may be mounted projectingly on side faces of the base ends of the fixed frames and another shoring may be mounted detachably through connecting braces connected to the brackets.

In this case, preferably, the support rod is constituted by a channel steel having a vertical guide channel, a first guide is fitted vertically movably on the back of the channel steel, while a second guide is vertically movably inserted into the guide channel, and either the front ends of the two upper braces or the front ends of the two lower braces are pivotally connected to one of the first and second guides.

In this case, the first guide may comprise a first slider which embraces the back of the channel steel and which is movable vertically and a support piece attached to the first slider, while the second guide may comprise a second slider inserted vertically movably into the guide channel and a bracket attached to the second slider, and the front ends of braces may be pivotally secured to both ends of the support piece and both ends of the bracket.

Preferably, the fixed frames each comprise a pair of hollow pipe struts standing up in parallel with each other, baluster struts mounted horizontally between the pipe struts, four diagonal members connected at base ends thereof to the upper and lower portions of the pipe struts, and a bracket to which the front ends of the diagonal members are gathered and connected.

In another aspect of the present invention there is provided a shoring comprising a pair of fixed frames opposed to each other and a pair of collapsible reinforcing frames disposed between both ends of the fixed frames, the reinforcing frames each comprising collapsible baluster struts whose base ends are pivotally secured between upper end portions of the fixed frames, collapsible horizontal support frames whose base ends are pivotally connected between lower ends of the fixed frames and which are disposed in parallel with the baluster struts, a support rod hinged between an intermediate position of the baluster struts and an intermediate position of the horizontal support frames, a guide fitted vertically slidably on the outer periphery of the upper portion of the support rod, and two braces hinged between both sides of the guide and to lower ends of the fixed frames.

DESCRIPTION OF THE PREFERRED EMBODIMENTS

The present invention will be described hereinunder by way of preferred embodiments thereof with reference to the accompanying drawings.

Figure 1:
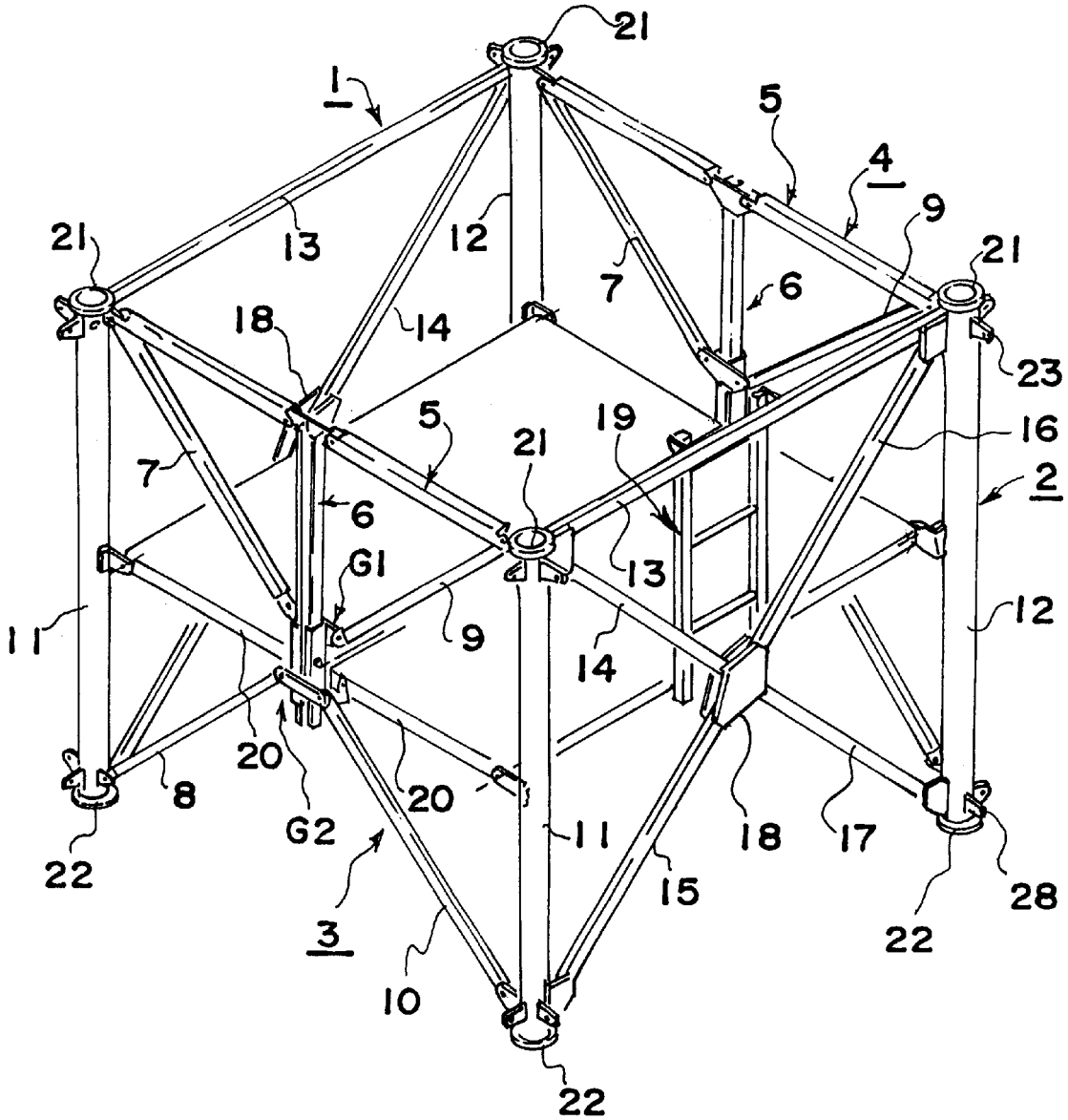
FIG. 1 is a perspective view of a short shoring according to an embodiment of the present invention.

FIG. 1 illustrates a shoring according to an embodiment of the present invention.

The shoring of this embodiment comprises a pair of right and left fixed frames 1, 2 opposed to each other, and a pair of front and rear collapsible reinforcing frames 3, 4 disposed respectively between both front ends and between both rear ends of the fixed frames 1, 2.

The reinforcing frames 3, 4 each comprise collapsible baluster struts 5 whose base ends are pivotally secured between end portions of the fixed frames 1, 2, a support rod 6 whose base end is pivotally mounted at an intermediate position of the baluster struts 5 and which is suspended downward, and four braces 7, 8, 9 and 10 whose base ends are pivotally secured to upper and lower end portions of the fixed frames 1, 2 and whose front ends are connected to the support rod 6 vertically movably.

The fixed frames 1 and 2 each comprise a pair of front and rear hollow pipe struts 11, 12, a baluster strut 13 mounted horizontally between the upper ends of the pipe struts 11 and 12, four diagonal members 14, 15, 16 and 17 connected at base ends thereof to the upper and lower portions of the pipe struts 11 and 12, and a bracket 18 to which are gathered and connected the front ends of the diagonal members 14, 15, 16 and 17.

A ladder 19 is mounted vertically in an inner central position of the right-hand fixed frame 2 so that workers can go up and down the ladder.

A pair of right and left floor plates 20, 20 collapsibly pivoted on inner intermediate positions of the pipe struts 11 and 12 are disposed inside the right and left fixed frames 1, 2. The shoring, however, may dispense with the floor plates 20, 20. At the upper and lower ends of the pipe struts 11 and 12 are mounted sockets 21 and perforated flanges 22, respectively.

The shoring shown in FIG. 1 is of a short basic structure, in which the reinforcing frames 3 and 4 are respectively provided inside the fixed frames 1 and 2. Not only this shoring is employable alone but also other shorings and jacks may be connected to the upper and lower ends of this shoring through the sockets 21 and flanges 22.

FIGS. 2 to 13 illustrate a shoring according to another embodiment of the present invention.

In this shoring, not less than two reinforcing frames 3 and 4 are disposed inside fixed frames 1 and 2. Its basic structure is the same as that of the shoring illustrated in FIG. 1. The shoring of this embodiment comprises a pair of opposed, vertically long, right and left fixed frames 1, 2, and a pair of collapsible front and rear reinforcing frames 3, 4 disposed respectively between both front ends and between both rear ends of the fixed frames 1, 2. The reinforcing frames 3 and 4, which are provided vertically in two stages, each comprise collapsible baluster struts 5 whose base ends are pivotally connected between end portions of the fixed frames 1 and 2, a support rod 6 whose base end is pivotally secured to an intermediate position of the baluster struts 5 and which is suspended downward, and four braces 7, 8, 9 and 10 whose base ends are pivotally secured to upper and lower ends of the fixed frames 1, 2 and whose front ends are connected vertically movably to the support rod 6.

In the shoring of this embodiment, like the shoring illustrated in FIG. 1, the fixed frames 1 and 2 each comprise a pair of front and rear long hollow pipe struts 11, 12, baluster struts 13 mounted horizontally between the upper ends of the pipe struts 11 and 12 in both upper and intermediate positions, two upper and lower sets of four diagonal members 14, 15, 16 and 17 whose base ends are connected to upper and lower portions of the pipe struts 11 and 12, and brackets 18 to which are gathered and connected the front ends of the diagonal members 14, 15, 16 and 17. Thus, the shoring is constituted as a rigid structure.

A ladder 19 is mounted vertically in an inner central position of the right-hand fixed frame 2 so that workers can go up and down the ladder.

Two upper and lower sets of a pair of right and left floor plates 20, 20 collapsibly pivoted on inner intermediate positions of the pipe struts 11 and 12 are diposed inside the right and left fixed frames 1, 2. The shoring, however, may dispense with the floor plates 20, 20. At the upper and lower ends of the pipe struts 11 and 12 are mounted sockets 21 and perforated flanges 22, respectively.

Figure 2:
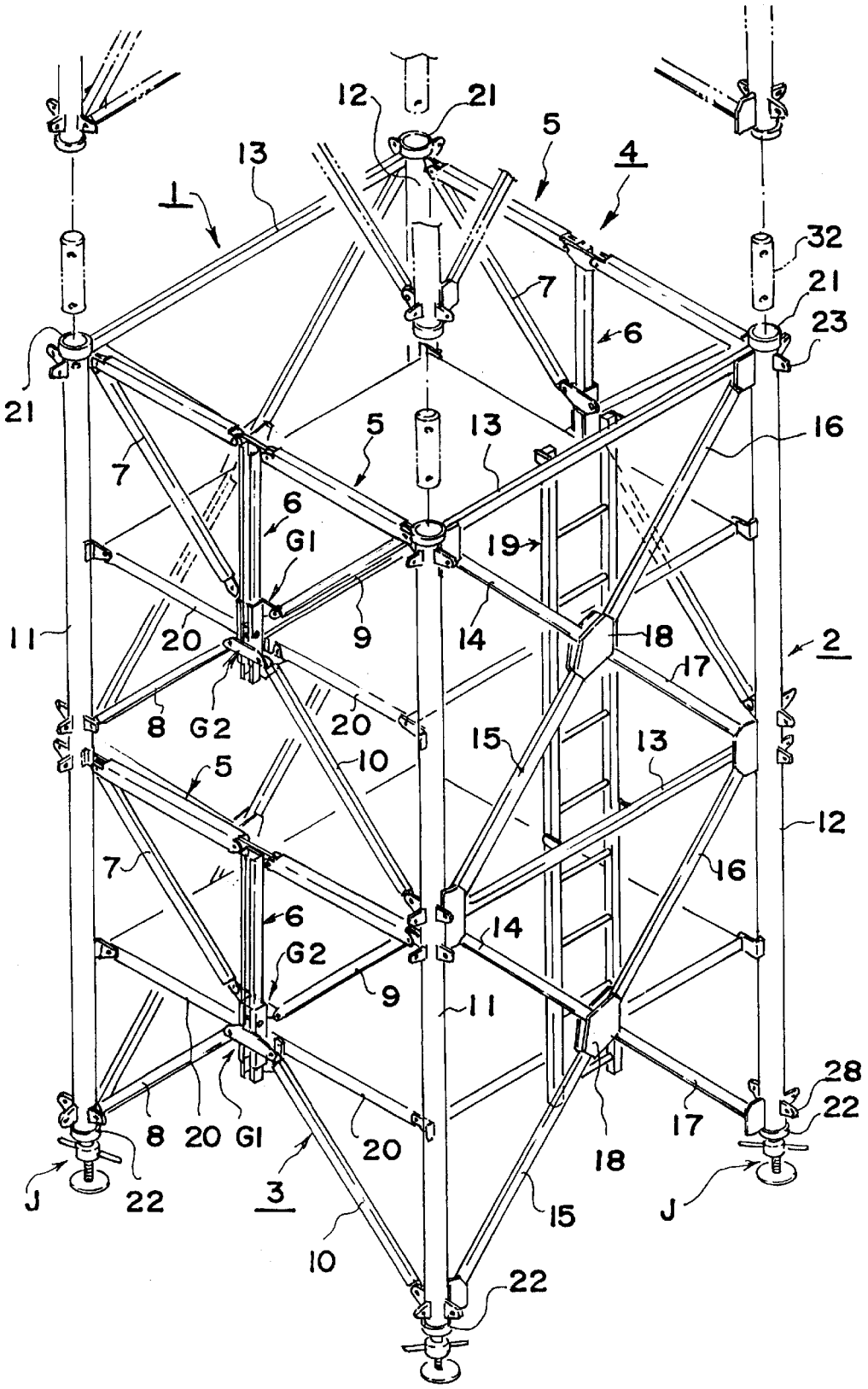
FIG. 2 is a perspective view of a long shoring according to another embodiment of the present invention.

The following description is now provided with reference to FIGS. 2 to 12, in which detailed members and mechanisms which constitute the fixed frames 1, 2 and reinforcing frames 3, 4 are common to those in the shorings of FIGS. 1 and 2.

Figure 4:
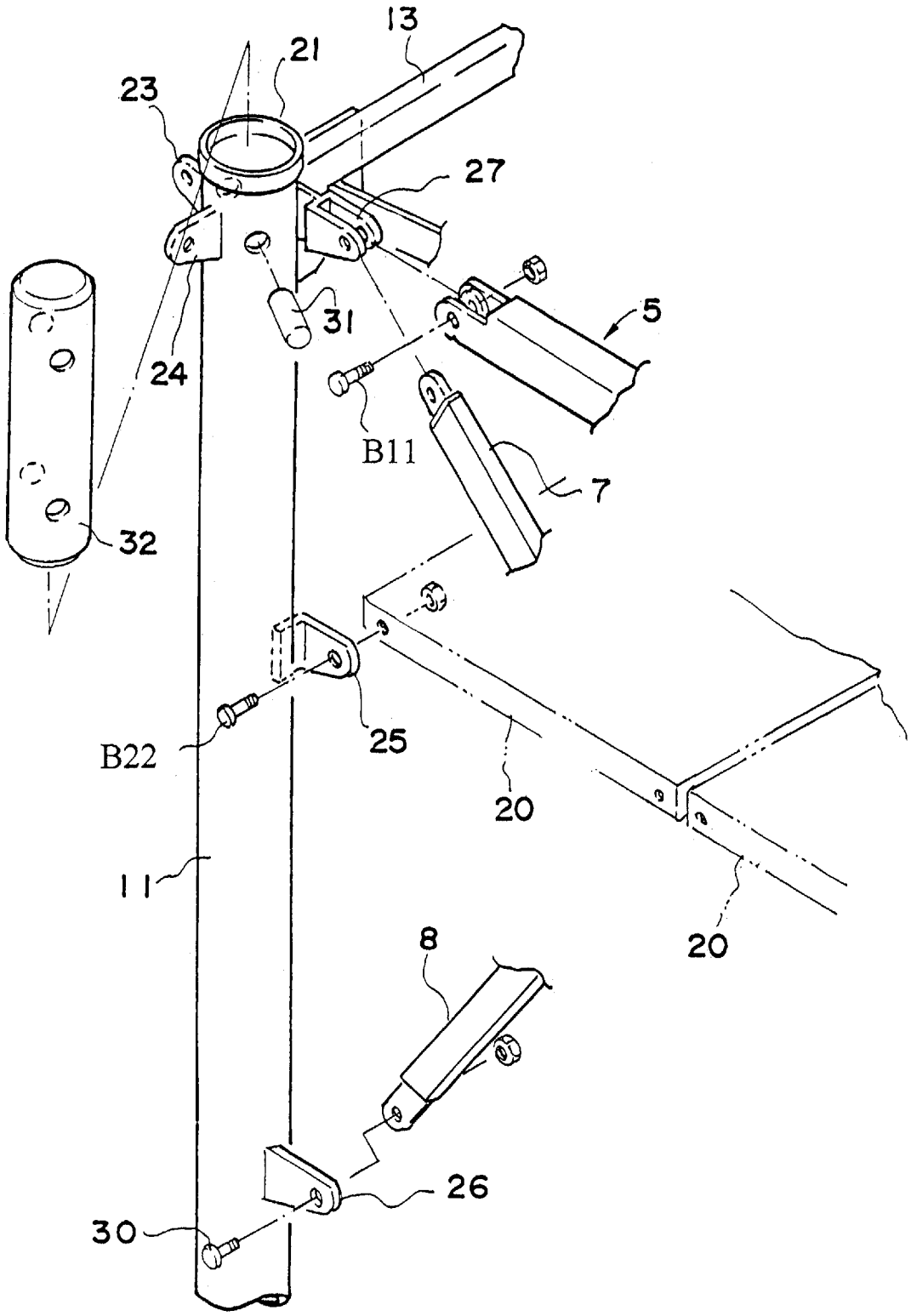
FIG. 4 is a perspective view of a left-hand pipe strut.

FIG. 4 illustrates a mechanism for mounting the reinforcing frame 3 and floor plate 20 in the upper stage to the upper portion of the left-hand pipe strut 11.

Lug-like brackets 23 and 24 projecting outward and a bifurcated bracket 27 projecting horizontally inward are formed at the upper end portion of the pipe strut 11. Further, two inwardly projecting lug-like brackets 25 and 26 are formed in upper and approximately intermediate positions of the pipe strut 11.

A base end of a baluster strut 5 is pivotally connected to the bifurcated bracket 27 through a bolt B11 in a horizontally rotatable manner, and a base end of a brace 7 constituted by a single pillar-like pipe is also pivotally connected to the bifurcated bracket 27 obliquely downward.

A base end face of a floor plate 20 is pivotally connected to the upper bracket 25 through a bolt B22, and a base end of a brace 8 constituted by a single pillar-like pipe is pivotally connected to the intermediate bracket 26 through a bolt 30, the brace 8 extending obliquely upward.

Figure 3:
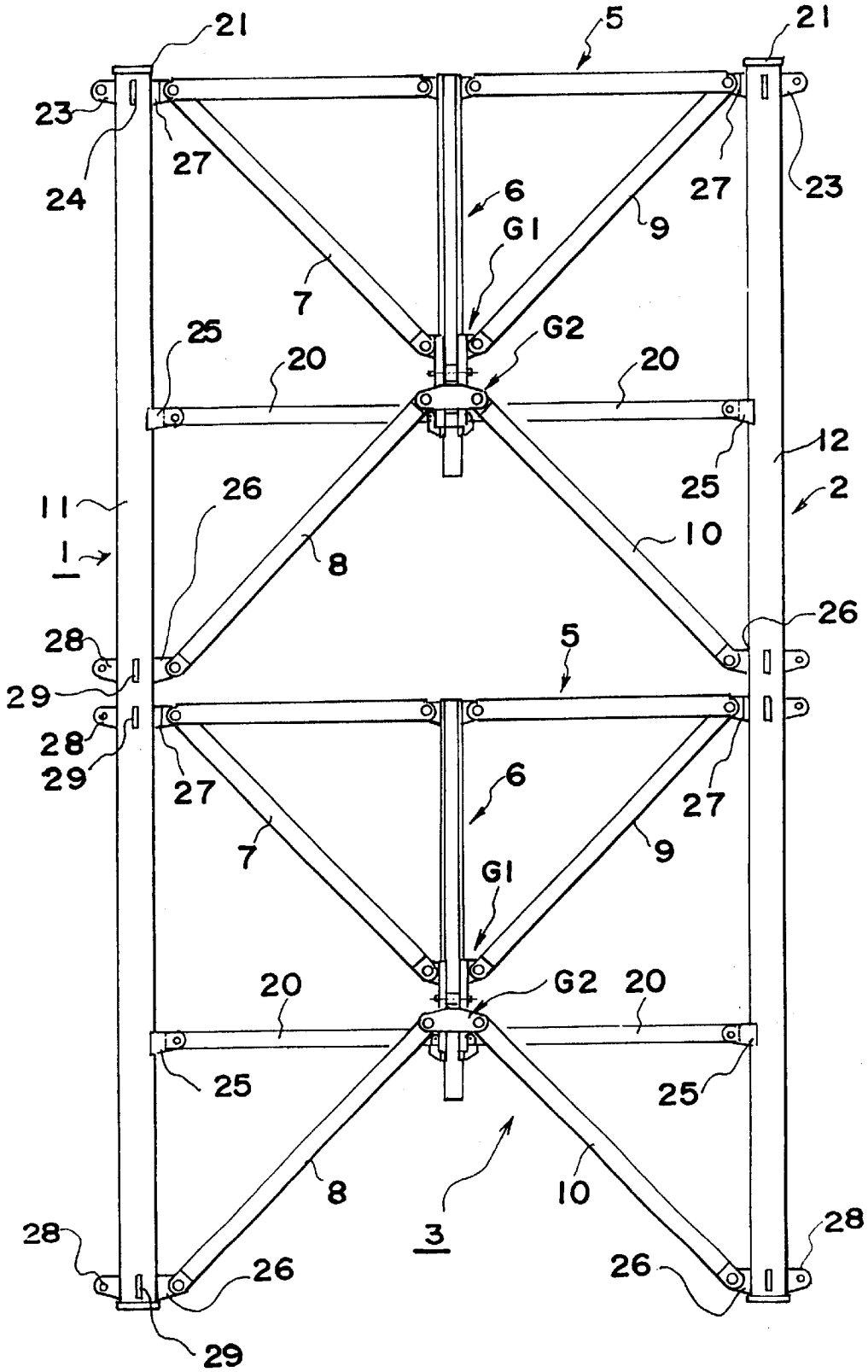
FIG. 3 is a front view thereof.

As is seen from FIG. 3, each bracket mechanism is provided also at the lower portion of the pipe strut 11 to connect thereto the lower-stage reinforcing frame 3*a* and floor plate 20.

Into the upper-end socket 21 of the pipe strut 11 is inserted a pipe joint 32 through a pin 31 so that its height can be adjusted. Another shoring or an auxiliary shoring unit is connected above to the shoring in question through the joint 32. Further, two brackets 28 and 29 projecting perpendicularly outward are mounted in positions opposed to the brackets 26 and 27, thereby permitting contiguous mounting of another shoring sideways.

Figure 5:
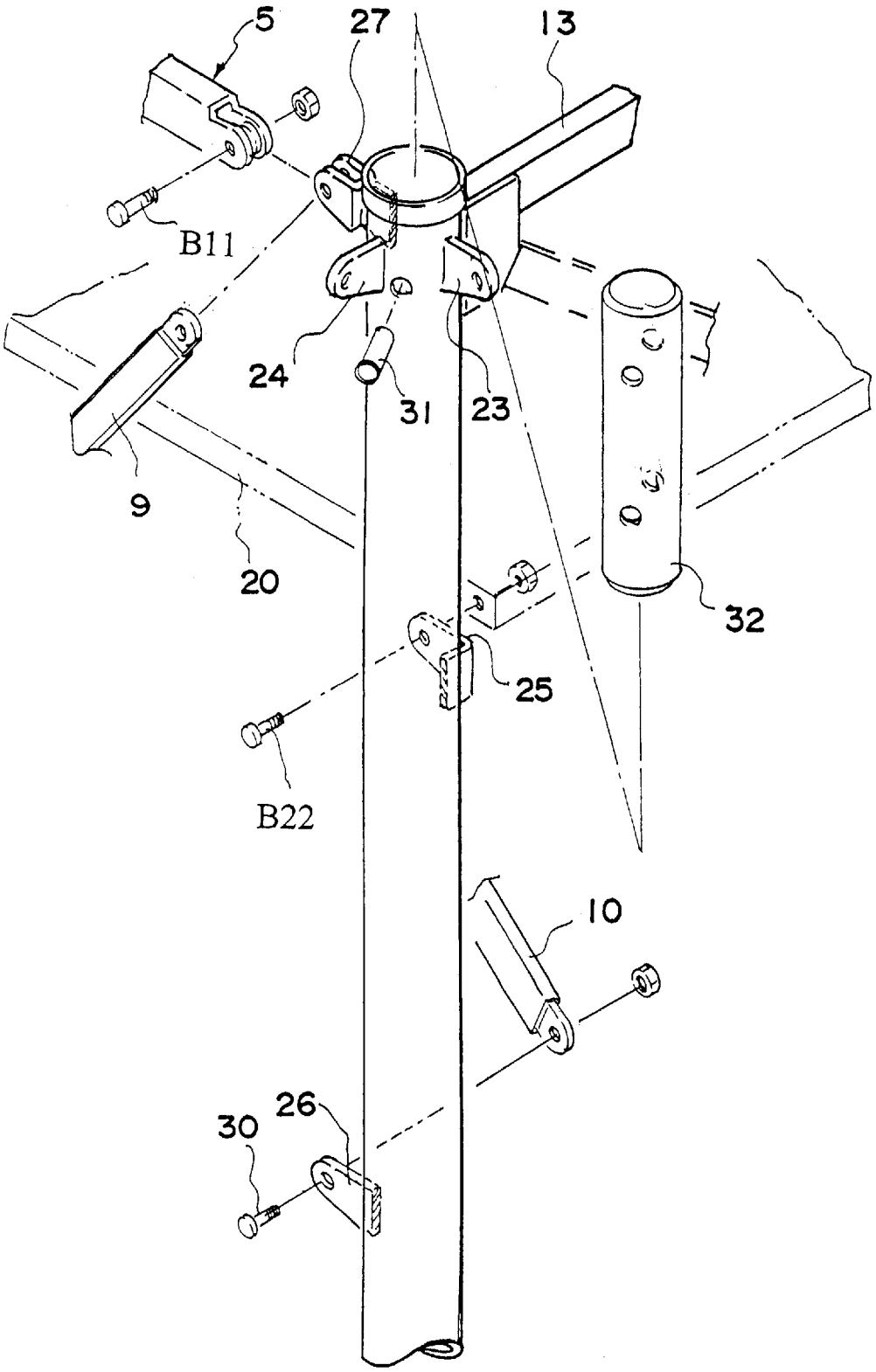
FIG. 5 is a perspective view of a right-hand pipe strut.
Figure 6:
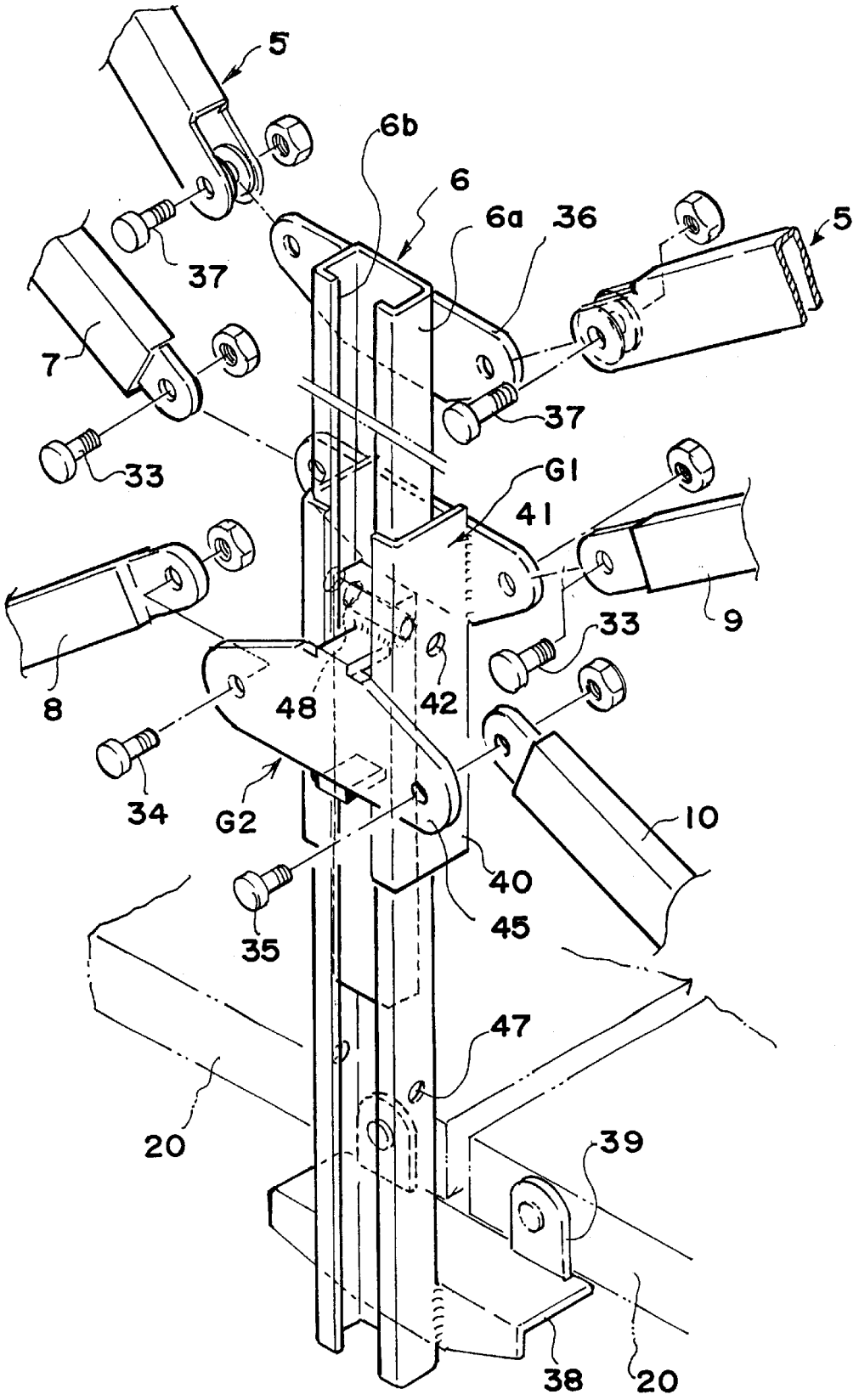
FIG. 6 is a partially cut-away perspective view of a support rod and first and second guides provided on the support rod.

FIG. 5 illustrates a mechanism for mounting the reinforcing frame 3 and floor plate 20 in the upper stage to the upper portion of the right-hand pipe strut 11. This mechanism is symmetric with and the same as the mounting mechanism for the left-hand pipe strut. That is, lug-like brackets 23 and 24 projecting outward and a bifurcated bracket 27 projecting horizontally inward are formed at the upper end portion of the pipe strut 11. Likewise, two lug-like brackets 25 and 26 projecting inward are formed in upper and approximately intermediate positions of the pipe strut 11.

A base end of a baluster strut 5 is pivotally connected to the bifurcated bracket 27 through a bolt B11 in a horizontally rotatable manner, and a base end of a brace 9 constituted by a single pillar-like pipe is also pivotally connected to the bifurcated bracket 27 obliquely downward.

A base end face of a floor plate 20 is pivotally connected to the upper bracket 25 through a bolt B22, and a base end of a brace 10 constituted by a single pillar-like pipe is pivotally connected to the intermediate bracket 26 through a bolt 30, the brace 8 extending obliquely upward.

Further, as is seen from FIG. 3, each bracket mechanism is provided also at the lower portion of the pipe strut 11 to connect thereto the lower-stage reinforcing frame and floor plate 20.

Likewise, into the upper-end socket 21 of the pipe strut 11 is inserted a pipe joint 32 through a pin 31 so that its height can be adjusted. Another shoring or an auxiliary shoring unit is connected above to the shoring in question through the joint 32. Further, two brackets 28 and 29 projecting perpendicularly outward are mounted in positions opposed to the brackets 26 and 27, thereby permitting contiguous mounting of another shoring sideways.

FIGS. 6 to 10 illustrate a mounting mechanism for mounting the braces 7, 8, 9, 10 and floor plates 20 to the support rod 6. This mounting mechanism is common to that illustrated in each embodiment of FIGS. 1 and 2.

The support rod 6 is formed to be C-chaped in section and is composed of a channel steel 6*a* having a guide channel 6*b* in the vertical direction and having a predetermined length.

A first guide G1 is fitted vertically movably on the back side of the channel steel 6*a*, while a second guide G2 is inserted vertically movably into the guide channel 6*b*, and to the first guide G1 are connected pivotally the front ends of two upper braces 7 and 9 through bolts 22, while to the second guide G2 are connected pivotally the front ends of two lower braces 8 and 10 through bolts 34. Alternatively, the lower braces 8 and 10 may be pivotally connected to the first guide G1 and the upper braces 7 and 9 may be pivotally connected to the second guide G2.

A lug-like bracket 36 projecting right and left is mounted on the back side of the upper end of the channel steel 6*a*, and the front end of the baluster strut 5 is pivotally connected to the bracket 36 through a bolt 37. Further, two lug-like upright brackets 39 are secured to the back side of the lower portion of the channel steel 6*a* through a horizontal support plate 38, and the front ends of floor plates 20 are pivotally secured to the brackets 39 through bolts.

Figure 7:
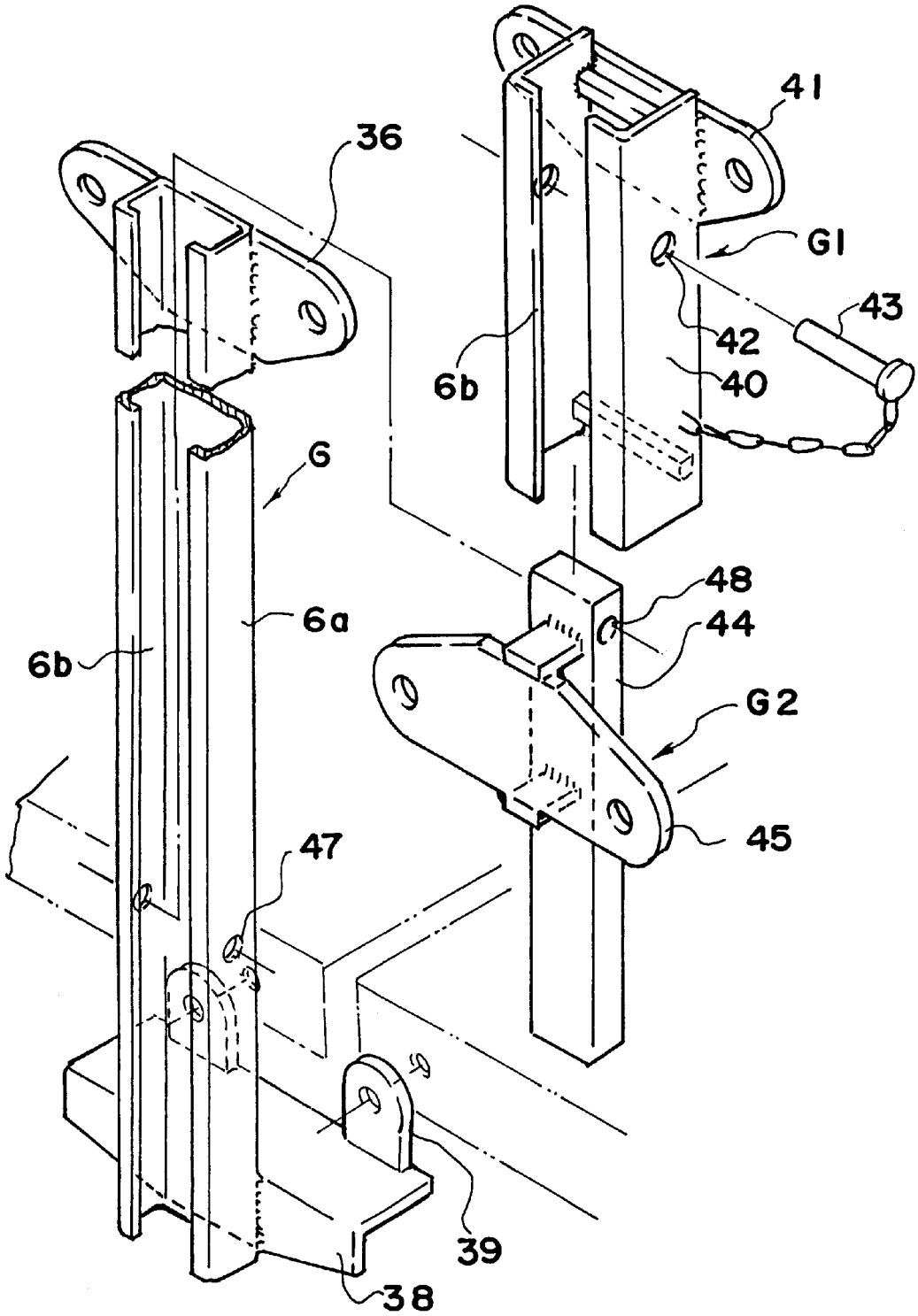
FIG. 7 is an exploded perspective view thereof.

As shown in FIG. 7, the first guide G1 comprises a first slider 40 constituted by two L-shaped steel pieces which embrace the back of the channel steel 6*a* and which are slidable vertically, and a support piece 41 attached to the first slider 40, with braces 7 and 9 being pivotally connected to the support piece 41.

Figure 8:
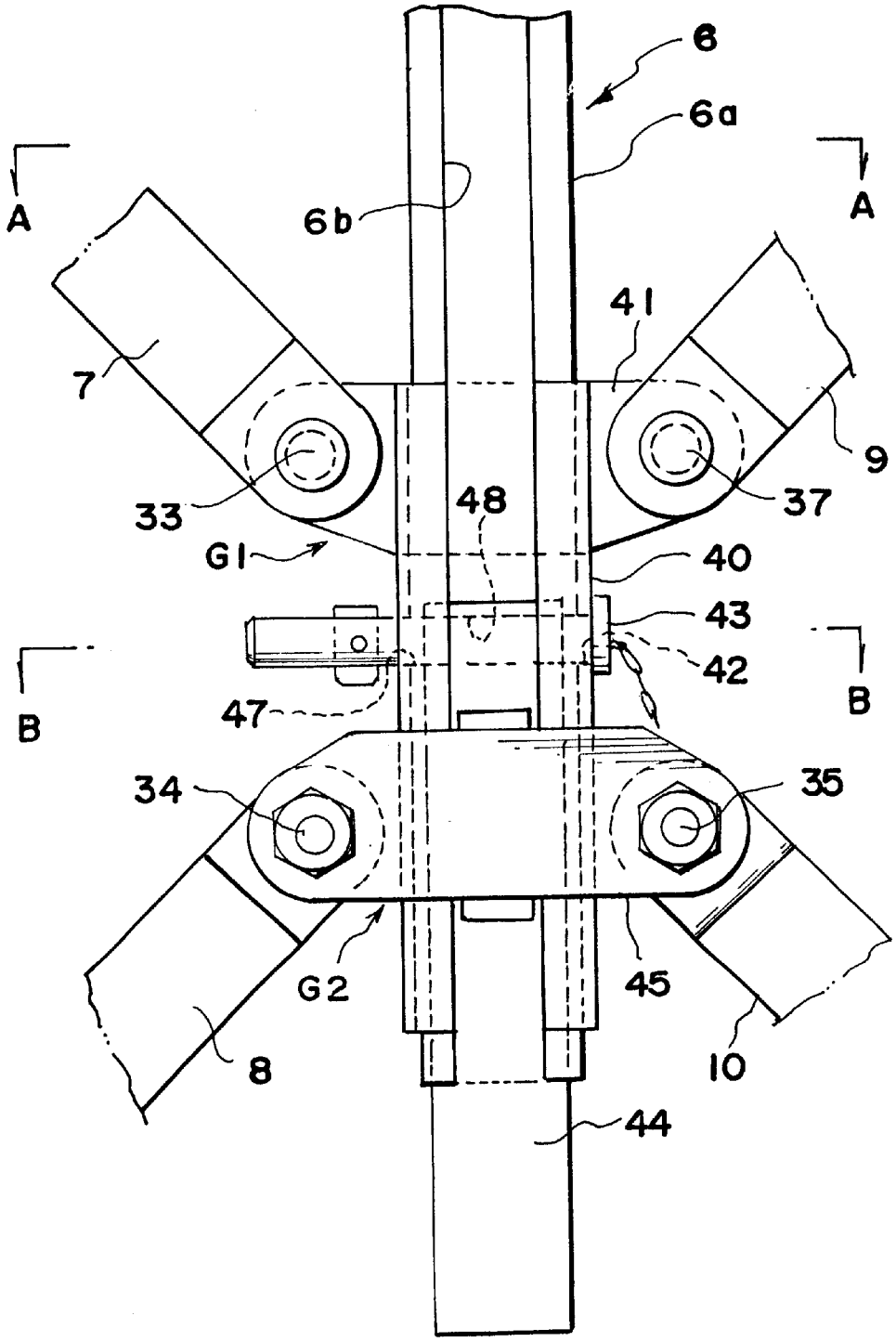
FIG. 8 is an enlarged front view thereof.
Figure 9:
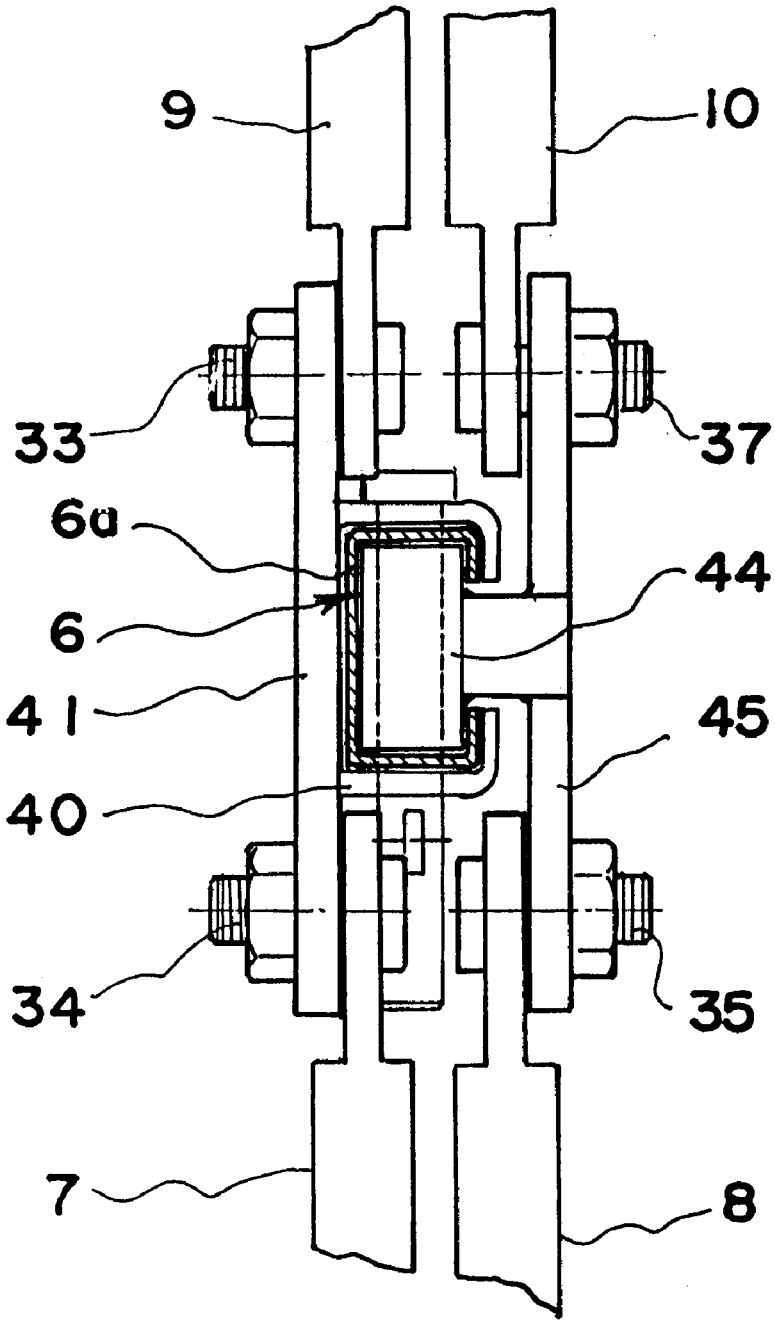
FIG. 9 is a plan view in transverse section taken on line A—A in FIG. 8.
Figure 10:
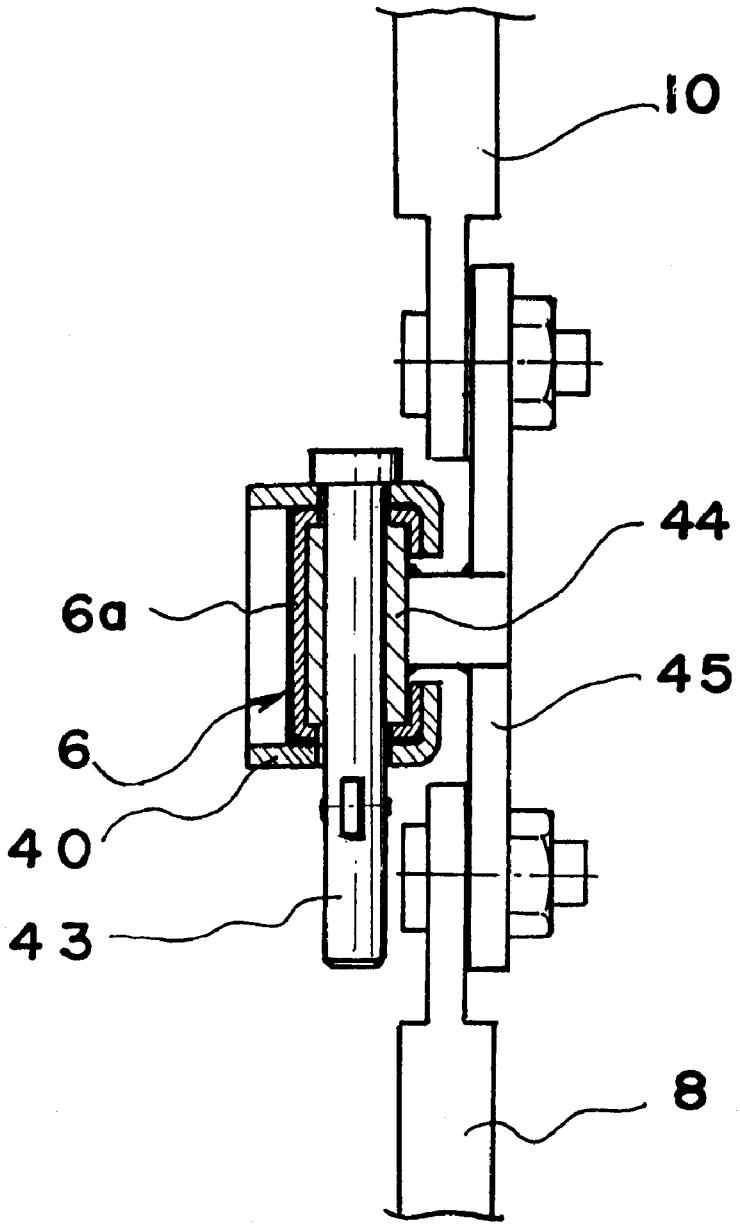
FIG. 10 is a plan view in transverse section taken on line B—B in FIG. 8.

Holes 42 are formed in the first slider 40 and a stopper pin 43 is inserted detachably into the holes 42. A retaining hole 47 is formed in a lower position of the channel steel 6*a* correspondingly to the hole 42. When the pin 43 is inserted into both hole 42 and retaining hole 47, the first slider 40 stops in the position of the retaining hole 47, as shown in FIG. 8.

Likewise, as shown in FIG. 7, the second guide G2 comprises a second slider 44 constituted by a pillar body and inserted vertically movably into the guide channel 6, and a bracket 45 mounted on the front side of the slider 44 and projecting right and left. Braces 8 and 10 are pivotally connected to both sides of the bracket 45.

A through hole 48 is formed in the second slider 44. When the pin, which has been inserted through the retaining hole 47 formed in a lower position of the channel steel 6*a*, is inserted into the through hole 48, the second slider 44 stops in the position of the retaining hole 47 simultaneously with the first slider 40, as shown in FIG. 8.

The following description is now provided about in what manner the shoring operates in use.

When the shorings shown in FIGS. 1 and 2 are assembled in such shapes of cube and rectangular parallelepiped as illustrated in those figures, the first guide Gl and the second guide G2 are fixed in the lower position of the support rod 6 with the pin 43, as shown in FIG. 8. At this time, the baluster struts 5 and the floor plates 20 are held horizontally and the braces 7, 8, 9 and 10 are inclined in four directions, whereby the right and left pipe struts 11, 12 are raised in parallel with each other and are maintained in this state. Thus, the baluster struts 5, floor plates 20 and four braces 7, 8, 9, 10 bear transverse loads acting on the right and left pipe struts 11, 12 and thereby prevent the shoring itself from being compressed or distorted. In this state, the four pipe struts 11, 11, 12, 12 are allowed to stand up on the ground and a heavy object such as a bridge girder or a large truss is placed and borne by the fixed frames 1, 2 and the auxiliary frames 3, 4. In the case where a work is to be performed near the heavy object, workers can go up and down the ladder 19 and, if necessary, another work can be done even on the floor plates 20.

Where the shoring illustrated in FIG. 1 or FIG. 2 is to be removed after completion of the bridge building work and to be conveyed to another building site, it is folded in a compact shape and then conveyed.

Figure 11:
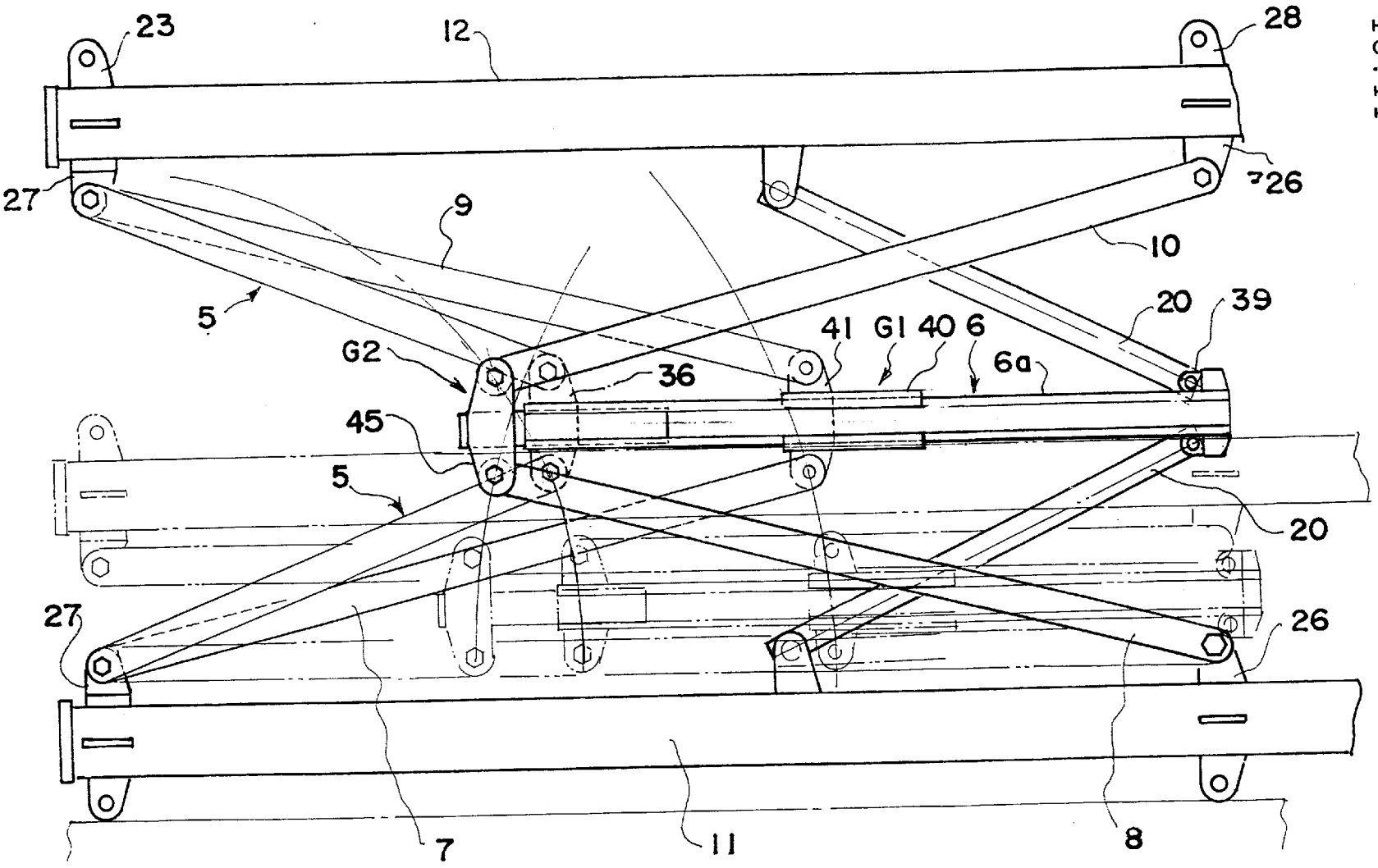
FIG. 11 is a partially enlarged front view showing a state in which the shoring is operatively folded.
Figure 12:
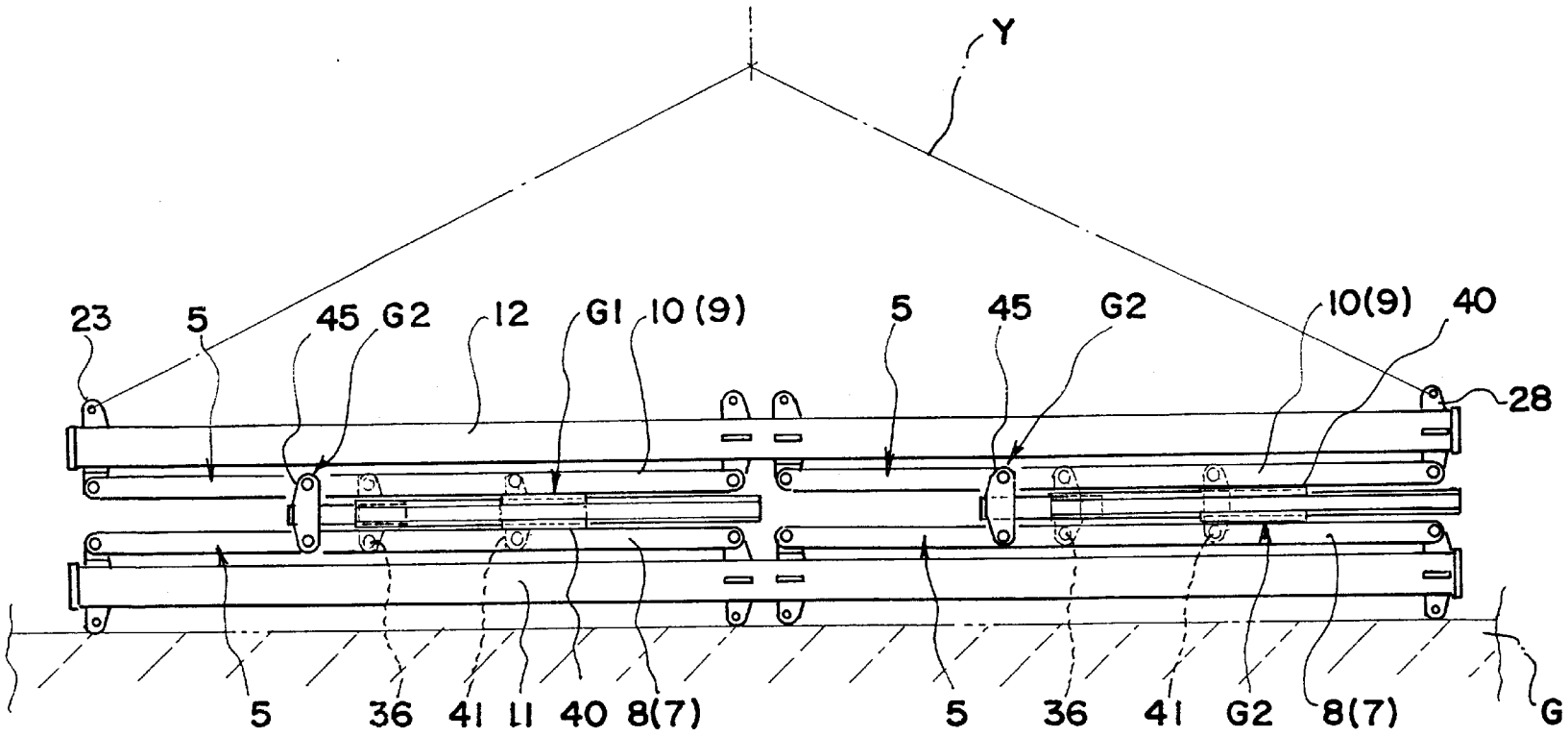
FIG. 12 is a front view of the whole of the shoring in a folded state.

For folding the shoring, the pin 43 is pulled out of the first and second guides G1, G2, then as shown in FIG. 12, then a wire Y is connected to the brackets 23 and 28 mounted on one pipe struts, for example the right-hand pipe struts 12, then the direction is changed by 90 degrees while suspending the wire Y with a crane or the like, allowing the left-hand pipe struts 11 to be placed on the ground G. In this case, as the crane is moved down, a load in the compressing direction acts from above on the whole of the shoring due to the weight of the right-hand pipe struts 12, with the result that the hinge portions at ends of the baluster struts 5, support rod 6, four braces 7, 8, 9, 10 and floor plates 20 move downward. More specifically, the support rod 6 and the first and second guides G1, G2 are disconnected from each other by pulling out the pin 43, so that both guides G1, G2 can now vertically move relatively along the support rod 6. Consequently, as shown in FIG. 11, the base ends of the baluster struts 5, floor plates 20 and four braces 7, 8, 9, 10 are urged in directions along the inner sides of the right and left pipe struts 11, 12. As a result, the support rod 6 moves down in FIG. 11, the first guide Gl slides relatively on the support rod 6 with the downward rotation of the braces 7 and 9, and the second guide G2 also moves upward on the support rod 6 with the upward rotation of the braces 8 and 10. Further, with the downward movement of the support rod 6, the baluster struts 5 and the floor plates 20 also turn downward. Finally, as shown in FIG. 12, all the baluster struts 5, floor plates 20 and four braces 7, 8, 9, 10 are stowed inside the right and left pipe struts 11, 12 and thus the whole of the shoring can be folded in a compact shape.

For assembling such a cube or rectangular parallelepiped as shown in FIG. 1 or FIG. 2 from the state of FIG. 12, the right-hand pipe struts are pulled up with the crane through the wire Y in a manner reverse to the above folding operation. As a result, the spacing between the right and left pipe struts 11, 12 expands gradually and the braces, etc. turn in the directions opposite to the directions in the previous folding operation. Upon formation of a cube or rectangular parallelepiped, the first and second guides G1, G2 are connected to the support rod 6 with the pin 43, again followed by a 90-degree change in direction, allowing the lower portions of the right and left pipe struts 11, 12 to stand up on the ground. Another auxiliary shoring unit may be connected above or below to the shoring shown in FIG. 1 or FIG. 2, or jacks J capable of being adjusted in their height may be mounted to the lower portions of the pipe struts 11 and 12.

Figure 13:
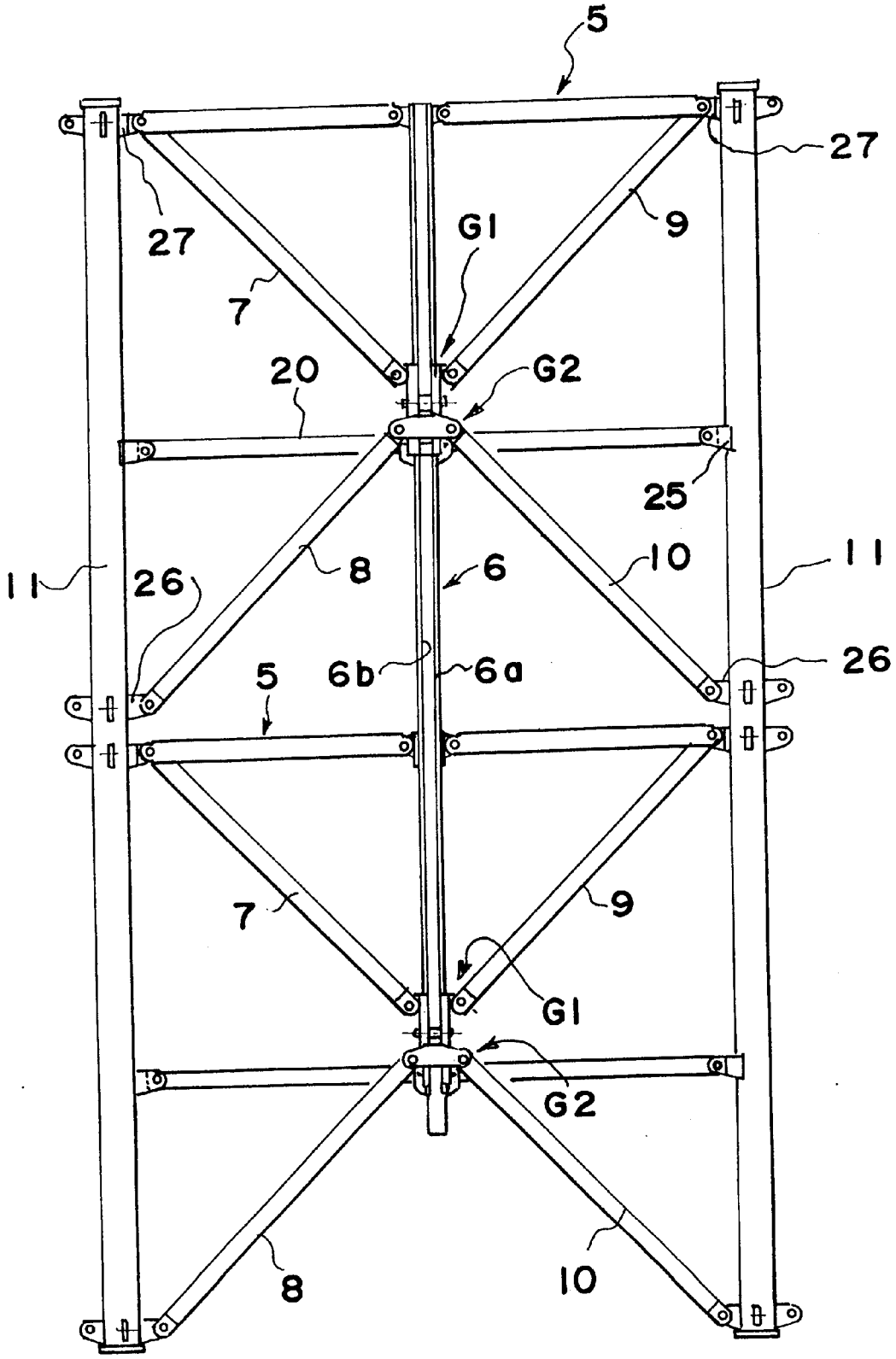
FIG. 13 is a front view of a shoring according to a further embodiment of the present invention.

FIG. 13 illustrates a further embodiment of the present invention, which is a modification of the shoring shown in FIG. 2 and in which a support rod 6 as a constituent of reinforcing frames 3 and 4 disposed in two upper and lower stages is formed vertically as an integral member. Other structural points, as well as function and effect, are the same as in the embodiment of FIG. 2.

Figure 14:
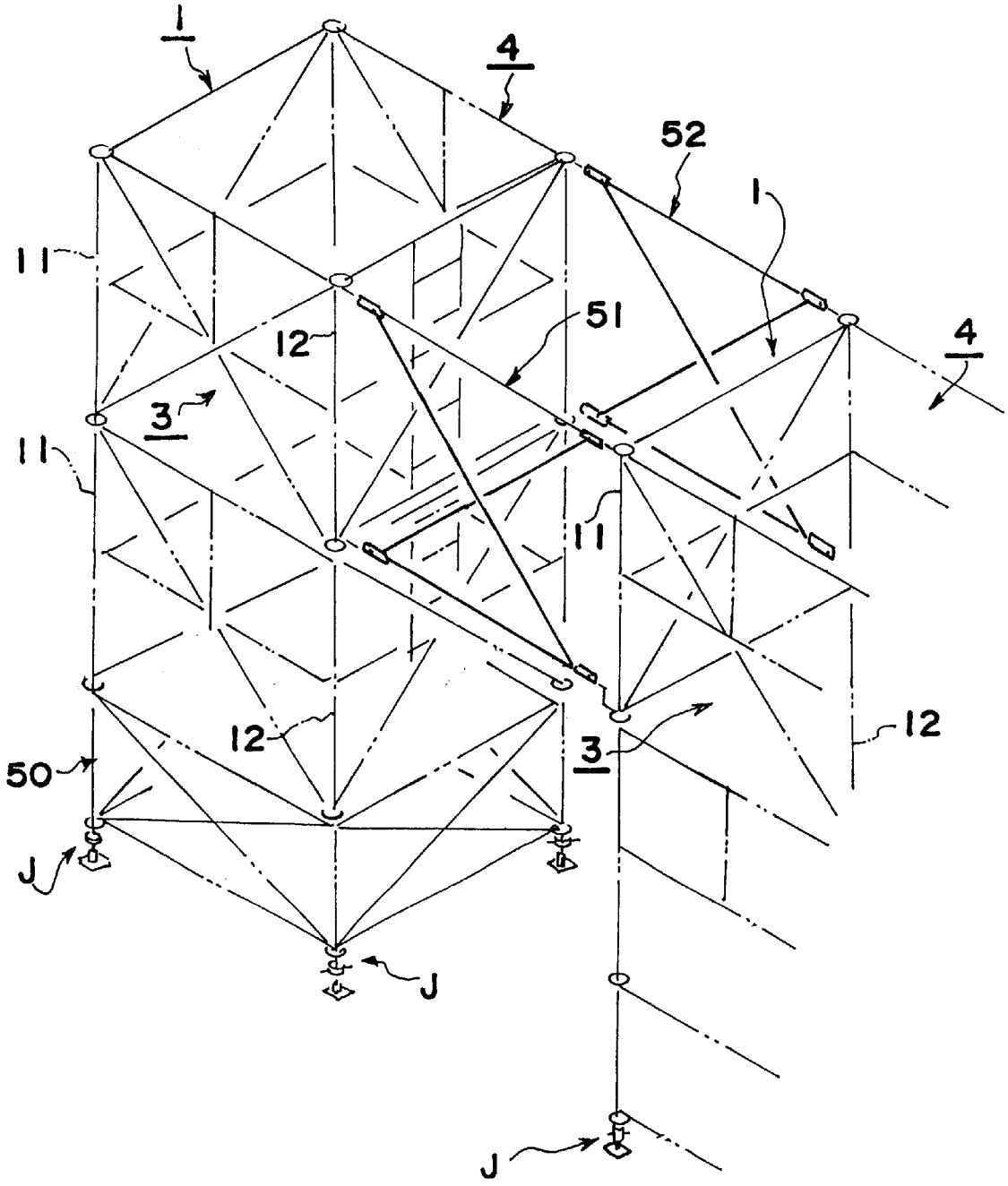
FIG. 14 is a schematic perspective view of a further embodiment of the present invention, showing a connected state of plural shorings.

FIG. 14 illustrates a further embodiment of the present invention.

In this embodiment, the shoring shown in FIG. 1 is used and two such shorings are stacked in two stages. Under this stack is placed an auxiliary tembering unit 50 and jacks J capable of being adjusted in their height are mounted to the underside of the shoring unit 50. Further, a plurality of such shoring stacks are arranged sideways and adjacent stacks are coupled together through two front and rear connecting braces 51, 52. Other shorings or auxiliary shoring unit arranged vertically in plural stages are coupled together through such sockets 21 or flanges 22 as shown in FIGS. 1 and 2.

Likewise, the two connecting braces 51 and 52 are connected to the associated shoring stacks through the outwardly projecting brackets 23 and 24 provided on pipe struts 11, 12.

Figure 15:
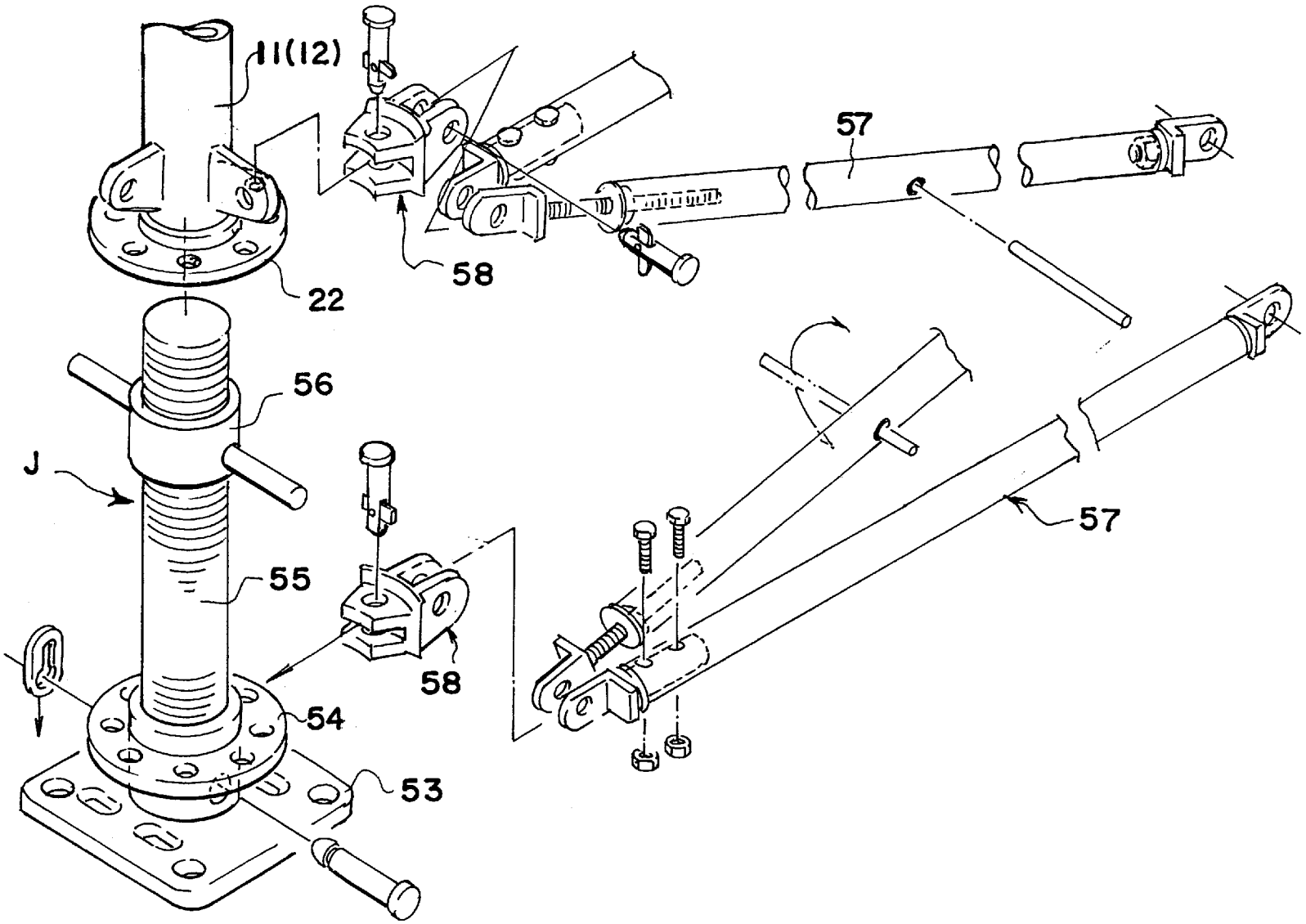
FIG. 15 is an exploded perspective view of a jack and braces connected thereto.

As shown in FIG. 15, the jack J comprises, for example, a jack base 53, a threaded rod 55 which stands up on the jack base 53, a perforated flange 54 provided on the lower portion of the threaded rod 55, and a position adjusting, cylindrical stopper 56 fitted rotatably on the threaded rod 55. Each pipe strut 11 (12) is fitted on the threaded rod 55 while adjusting the height with the stopper 56. For reinforcing the shorings assembled, shoes 58, 58 are connected to the flange 22 on the pipe strut 11 side and the flange 54 on the jack J side respectively, and braces 57, 57 are attached to the shoes 58, 58 horizontally or obliquely.

Figure 16:
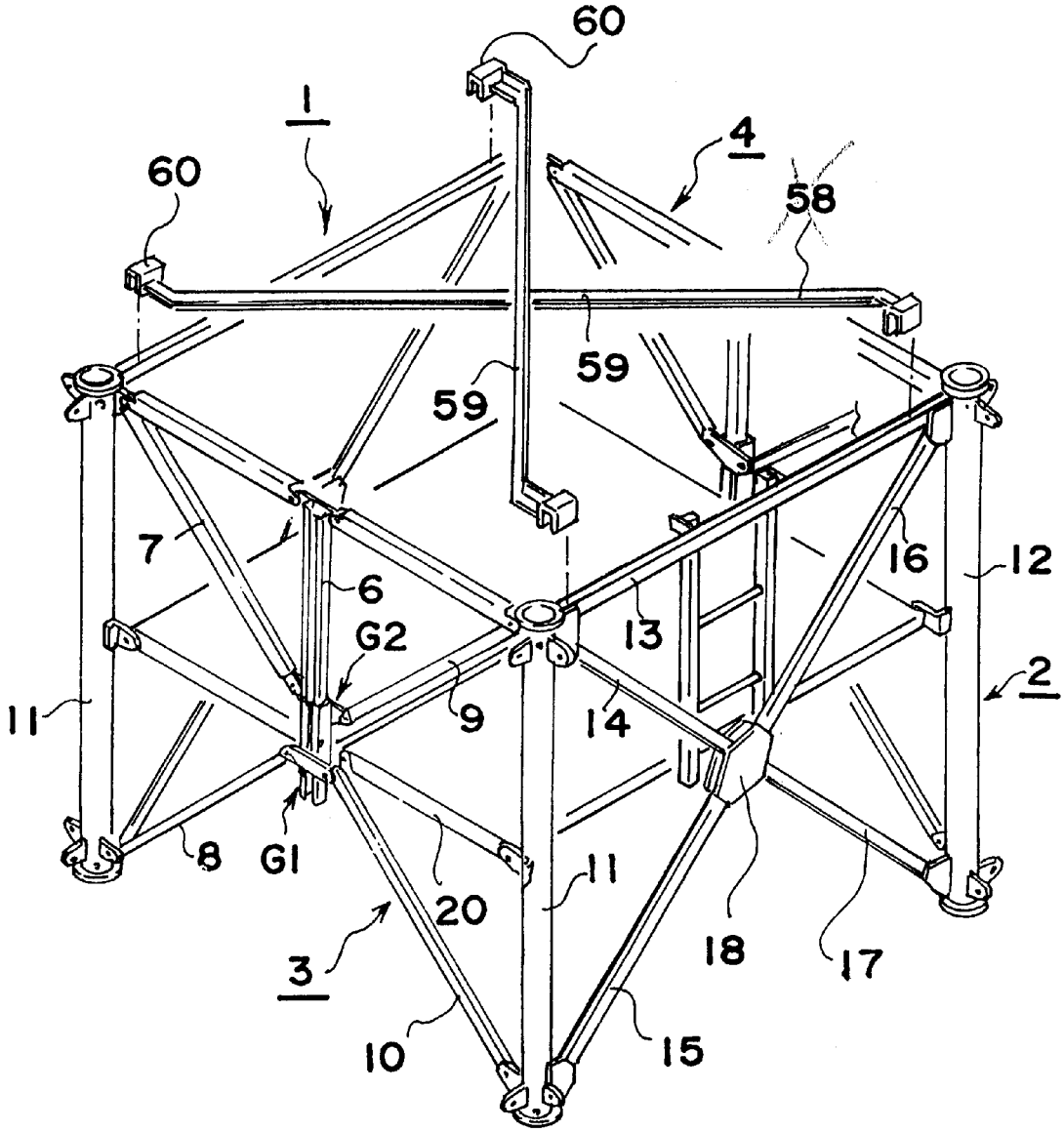
FIG. 16 is a perspective view of a shoring according to a further embodiment of the present invention.
Figure 17:
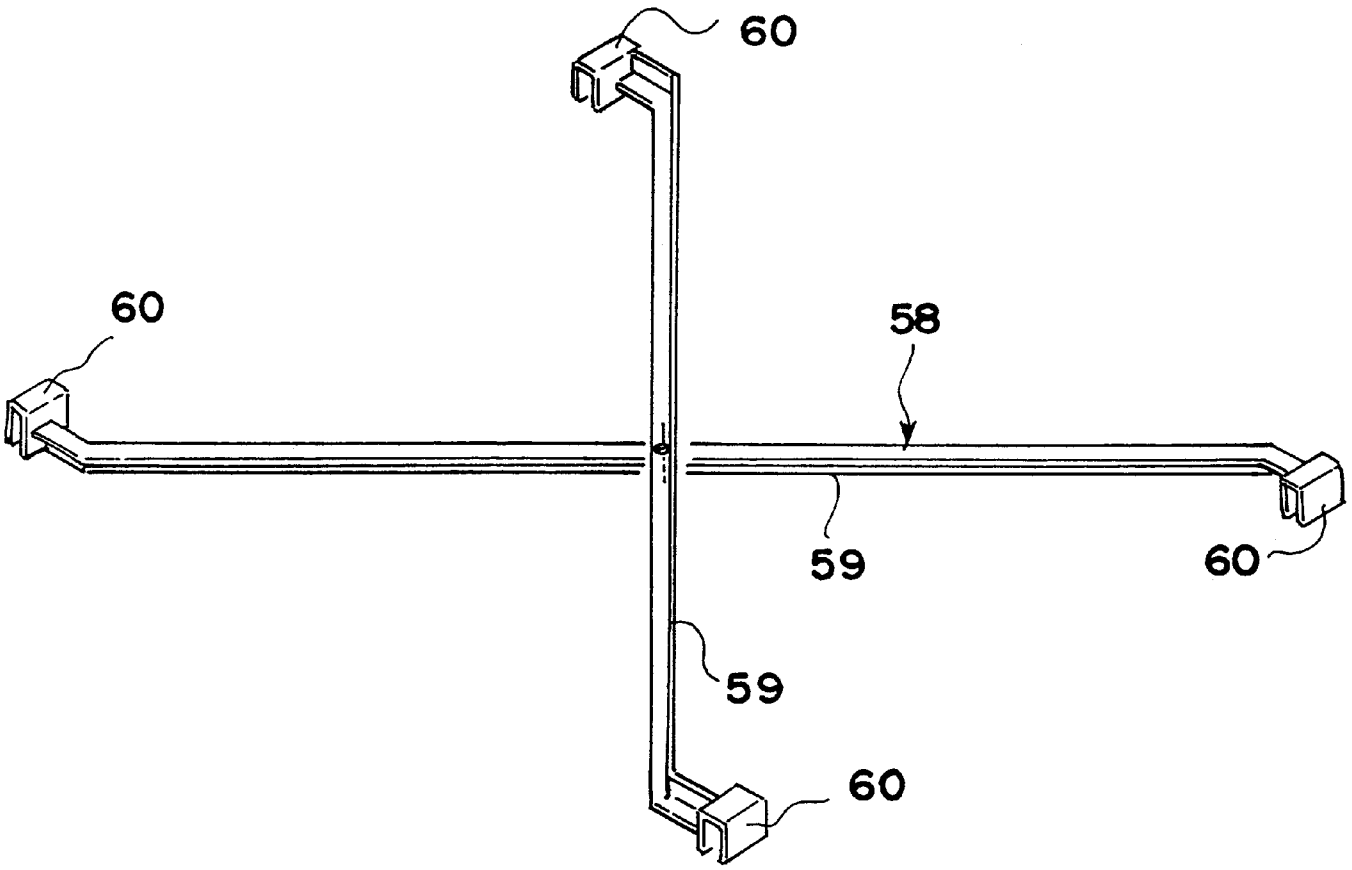
FIG. 17 is a perspective view of a horizontal brace.

FIGS. 16 and 17 illustrate a further embodiment of the present invention. In this embodiment, for reinforcing the shoring shown in FIG. 1 or FIG. 2, a reinforcing member comprising horizontal braces is provided at the upper end of the shoring.

More specifically, although the shoring shown in FIG. 1 can fully withstand lateral loads, there sometimes is mounted a horizontal brace means for maintaining the shoring in the shape of a cube or rectangular parallelepiped. The horizontal brace means comprises two reinforcing braces 59, 59 which cross each other in X shape and sockets 60, 60 having an inverted U-shaped section. The horizontal brace means is hooked detachably through the sockets 60, 60 to the upper ends of the baluster struts 13, 13 as constituents of the reinforcing frames 1 and 2 to bear a lateral load acted from the fixed frames 1 and 2 in cooperation with the reinforcing frames 3 and 4, thereby preventing distortion and deformation of the whole of the shoring.

It goes without saying that the horizontal brace means is applicable also to the shoring shown in FIG. 2.

Figure 18:
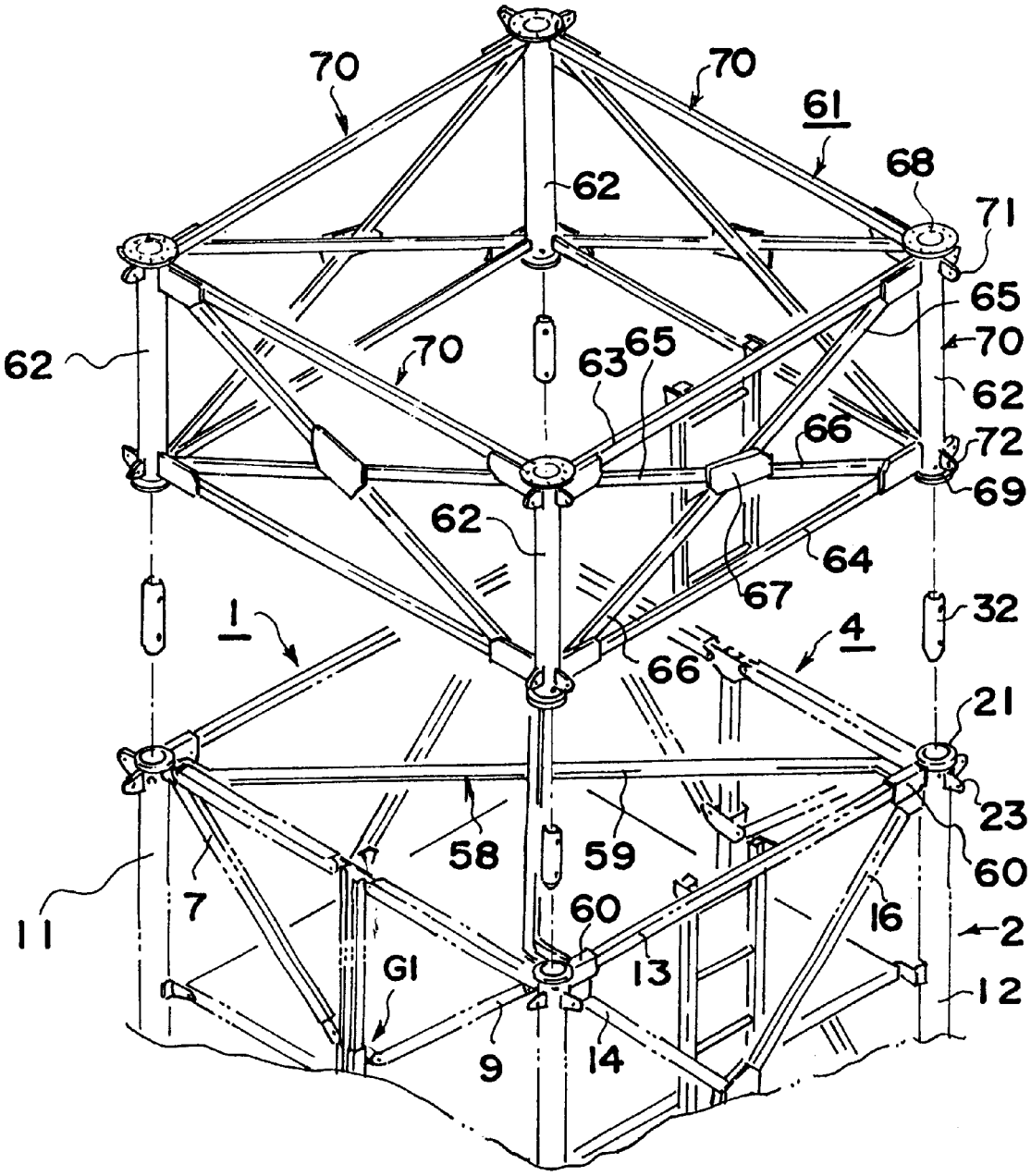
FIG. 18 is a perspective view of a shoring according to a further embodiment of the present invention.

FIG. 18 illustrates a further embodiment of the present invention, in which an auxiliary shoring unit is mounted on a shoring.

The shoring shown in FIG. 18 is the same as the shoring shown in FIG. 16, but there may be used the shoring of any of the embodiments illustrated in FIGS. 1, 2 and 13.

The auxiliary shoring unit, indicated at 61, is constituted by a rigid framework obtained by assembling four, front and rear, and left and right fixed frames 70 in a rectangular shape. The vertical length of the entire shoring is adjusted by connecting the auxiliary shoring unit 61 to the shoring. Through the auxiliary shoring unit 61, another shoring or auxiliary shoring unit 61 may be further mounted above.

The fixed frames 70 each comprise a pair of four, front and rear hollow pipes 62, baluster struts 63 and 64 doubling as auxiliary frames and horizontally mounted respectively between the upper and lower ends of the paired hollow pipes 62, 62, four reinforcing braces 65, 66 disposed inclinedly from the upper and lower ends of the paired hollow struts 62, 62, and a bracket 67 to which the front ends of the reinforcing braces 65 and 66 are gathered and connected. Thus, each fixed frame 70 is of the same structure as the fixed frames 1 and 2 shown in FIGS. 1 and 2.

Each pipe strut 62 has sockets 68, 69 formed at the upper and lower ends, and an auxiliary shoring unit 61 is connected to the shoring through a pipe-like joint 32 inserted into the socket 68 (69).

Figure 19:
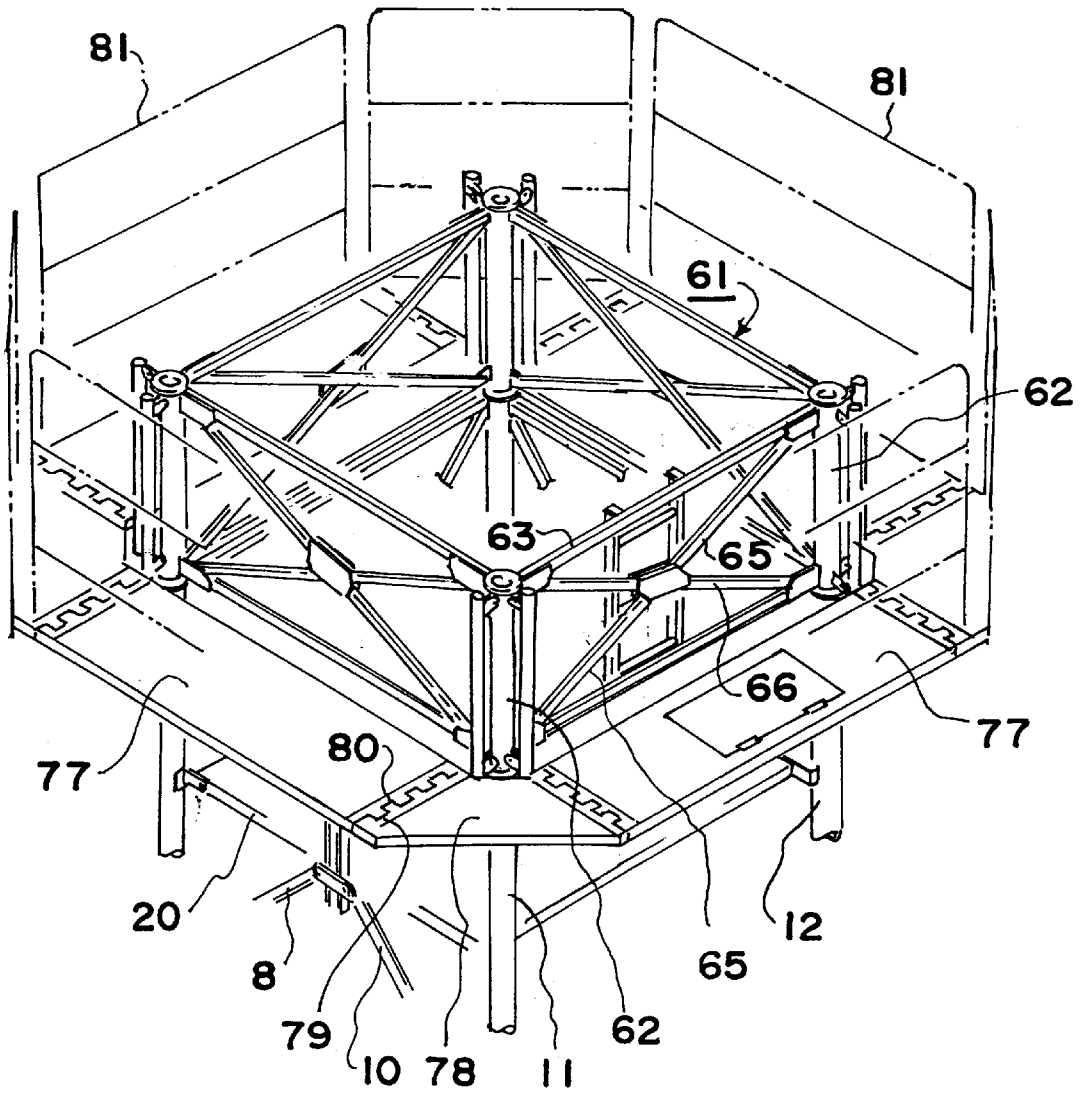
FIG. 19 is a perspective view showing a state in which a scaffold has been mounted to an auxiliary shoring unit.
Figure 20:
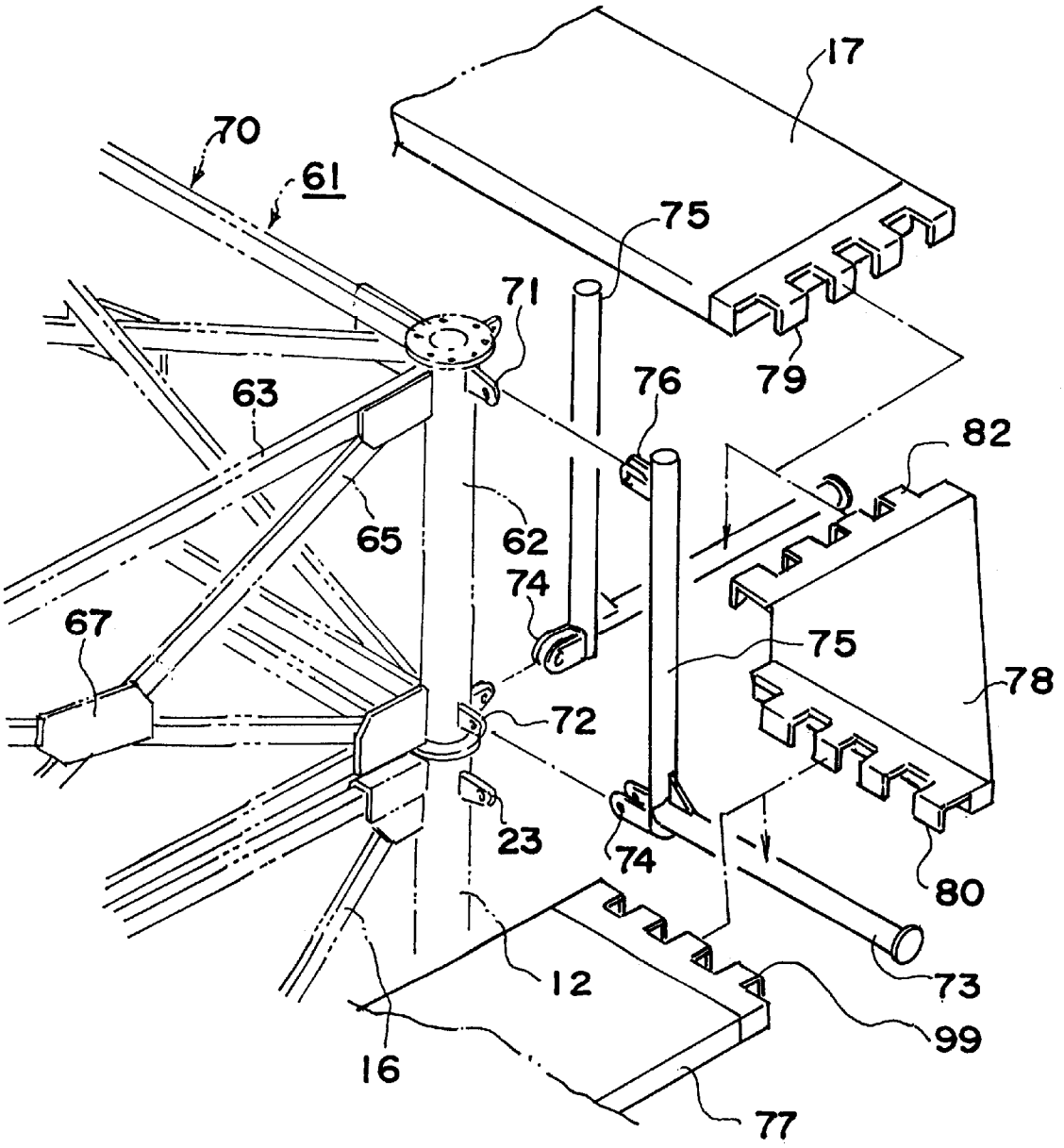
FIG. 20 is a partially exploded perspective view of FIG. 19.

FIGS. 19 and 20 illustrate a further embodiment of the present invention, in which a scaffold is mounted along the outer periphery of the auxiliary shoring unit 61 connected to the shoring shown in FIG. 18. Each pipe strut 62 as a constituent of the auxiliary shoring unit 61 is provided with a plurality of lug-like brackets 71 and 72 projecting outward respectively at the upper and lower portions of the pipe strut 62. A base-end bracket 74 of a horizontally projecting strut 73 is connected to the lower bracket 72. Further, an reinforcing strut 75 is fixed in a stand-up state to the base-end side of the strut 73, and a bracket 76 is mounted horizontally to the upper portion of the strut 75. The bracket 76 is connected to the upper bracket 71 of the pipe strut 62. In this way the struts 73 and 75 are firmly fixed outside the auxiliary shoring unit 61.

Each of end portions of a rectangularly parallelepipedic scaffolding board 77 and a triangular comer scaffolding board 78 is booked detachably onto the strut 73 through hook portions 79 and 80 of an inverted U-shaped section. Further, balustrades 81 are raised outside the scaffolding boards 77 and the comer scaffolding board 78. The struts 73, 75, the scaffolding boards 77, the comer scaffolding board 78 and the balustrades 81 constitute a scaffold. Although this scaffold is mounted for the auxiliary shoring unit 61, it may be mounted directly for the shoring shown in FIG. 1 or FIG. 2.

While a heavy object such as a bridge girder is borne by the shoring, the above scaffold is used for performing various works around the heavy object at the time of connection of the heavy object to the shoring or at the time of removal of the shoring.

FIGS. 21 to 25 illustrate a shoring according to a further embodiment of the present invention, which shoring is substantially the same as the shoring shown in FIG. 1, with reinforcing frames being modified. The shoring of this embodiment comprises a pair of opposed fixed frames 1, 2 and a pair of collapsible reinforcing frames 3*a*, 3*a* disposed between both end portions of the fixed frames 1 and 2. Each reinforcing frame 3*a* comprises collapsible baluster struts 5*a* whose base ends are connected between the upper ends of the fixed frames 1, 2 directly or through brackets 100, horizontal support frames 5*b* which are disposed in parallel with the baluster struts 5*a* and whose base ends are pivotally connected to the lower ends of the fixed frames 1, 2 directly or through brackets 101, a support rod 66 hinged between an intermediate hinge portion H1 of the baluster struts 5*a* and an intermediate hinge portion H2 of the horizontal support frames 5*b*, a cylindrical guide G3 fitted vertically slidably on the outer periphery of the upper portion of the support rod 66, and two braces 8*a*, 8*b* hinged between both-side brackets b of the guide G3 and the lower ends of the fixed frames 1, 2 or the brackets 101.

Bifurcated brackets B1, B1 are formed respectively at the upper ends of the braces 8*a* and 8*b* and each bracket B1 is pivotally connected to the bracket b through a bolt BT.

The hinge portion H1 comprises an upper-end support piece 110 of the support rod 66 and brackets 111 and 112 formed at end portions of the baluster struts 5*a*. The brackets 111 and 112 are put on both sides of the support piece 110 and are clamped together with a bolt 113.

In this embodiment, as in the embodiment illustrated in FIG. 1, the fixed frames 1 and 2 are each constituted as a rigid body by a pair of long, hollow, front and rear pipe struts 11, 12, a baluster strut 13 mounted horizontally between the upper ends of the pipe struts 11 and 12, four diagonal members 14, 15, 16, 17 whose base ends are connected to the upper and lower portions of the pipe struts 11 and 12, and a bracket 18 to which the front ends of the diagonal members 14, 15, 16 and 17 are gathered and connected.

A ladder 19 is mounted vertically in an inner central position of the right-hand fixed frame 2 so that workers can go up and down the ladder.

A pair of right and left floor plates 20*a*, 20*b* collapsibly pivoted on inner intermediate positions of the pipe struts 11 and 12 are disposed inside the right and left fixed frames 1, 2. The shoring, however, may dispense with the floor plates 20*a*, 20*b*.

Figure 21:
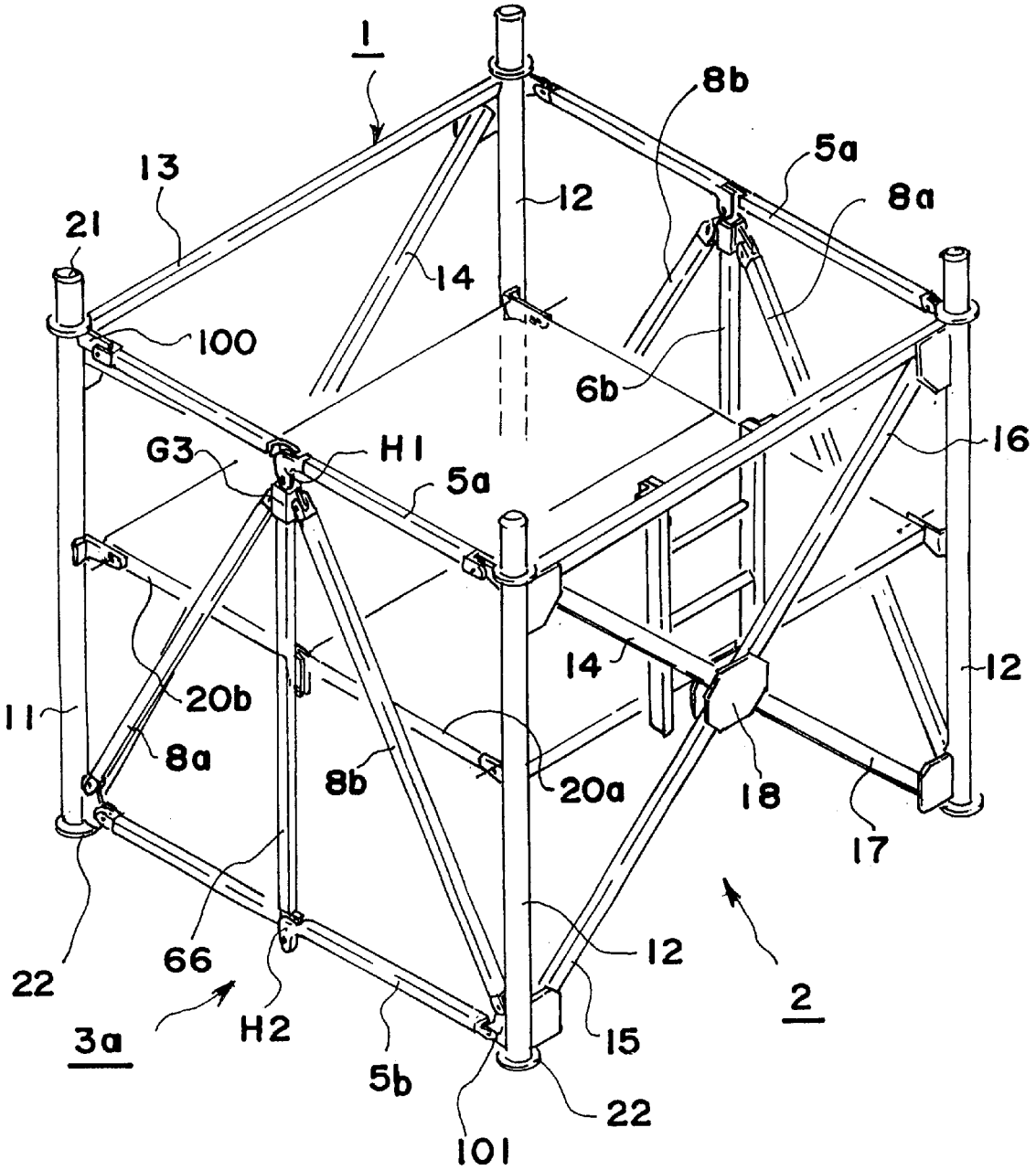
FIG. 21 is a perspective view of a shoring according to a further embodiment of the present invention.

The shoring illustrated in FIG. 21 is of a short basic structure in which the reinforcing frames 3*a*, 3*a* are disposed inside the fixed frames 1 and 2. This shoring is employable not only alone but also in combination with other shorings placed above and below through sockets and flanges as in FIG. 1, using jacks if necessary.

Figure 22:
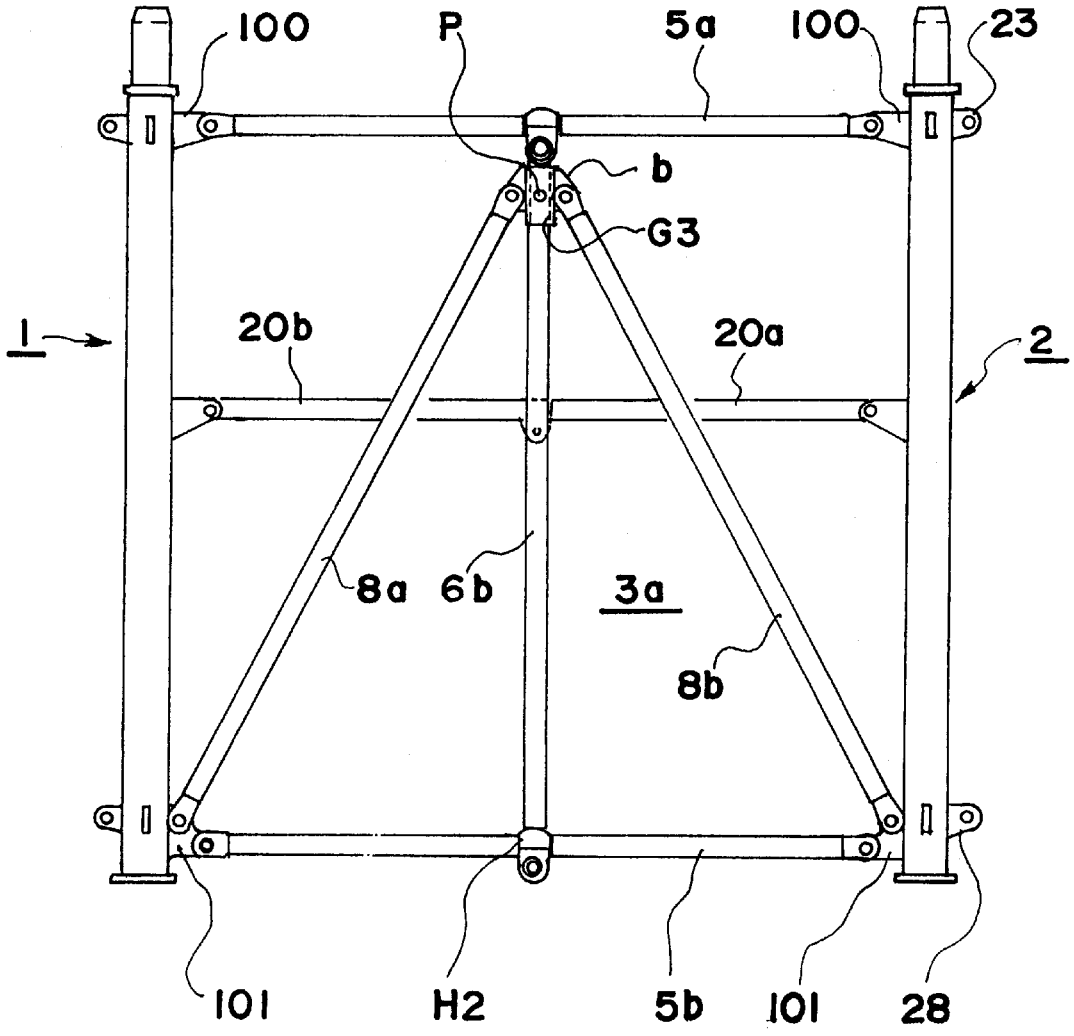
FIG. 22 is a front view thereof.
Figure 23:
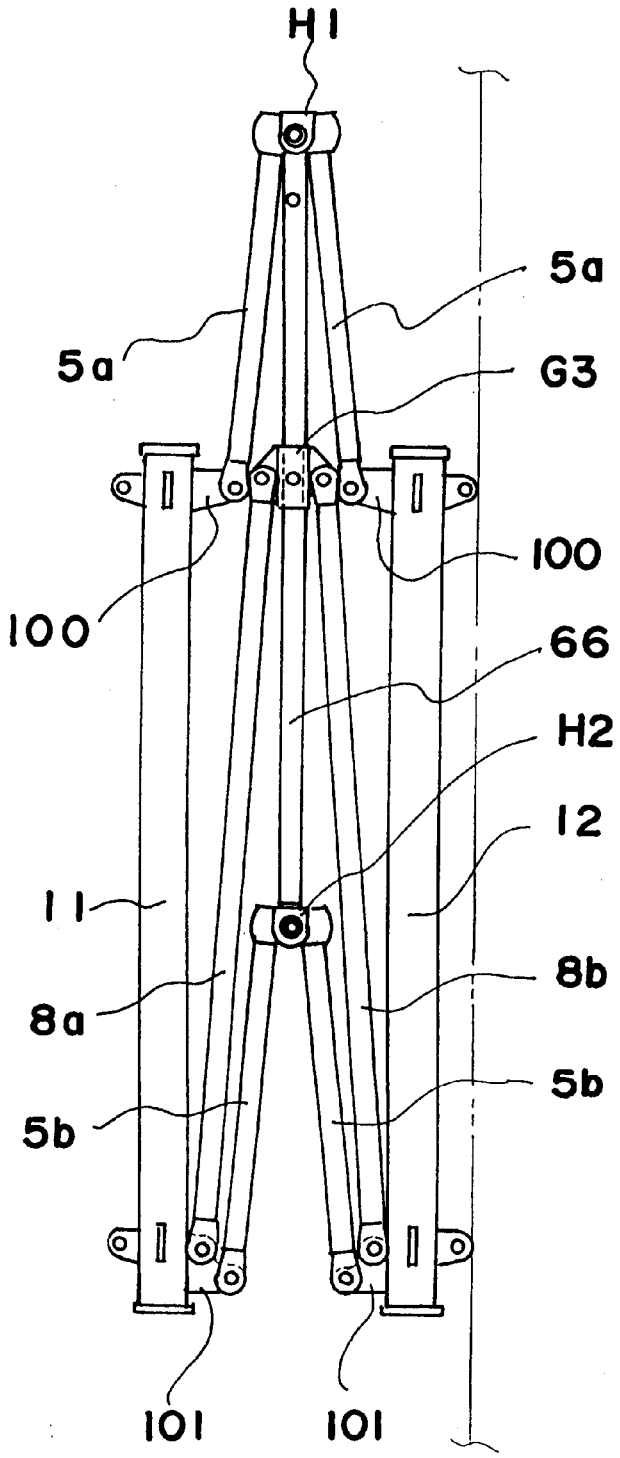
FIG. 23 is a front view showing a folded state of the shoring.
Figure 24:
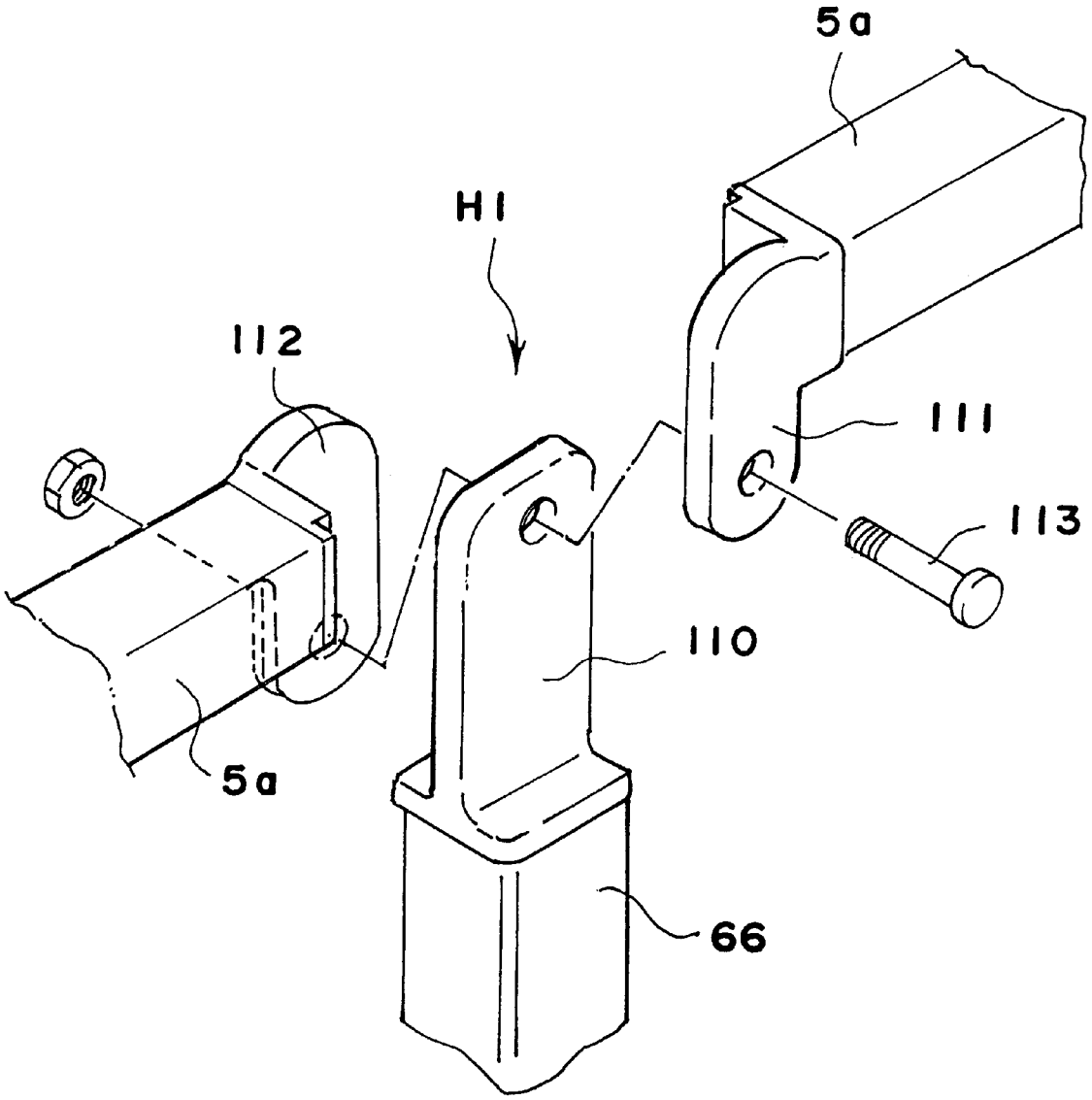
FIG. 24 is an enlarged perspective view of a hinge portion.
Figure 25:
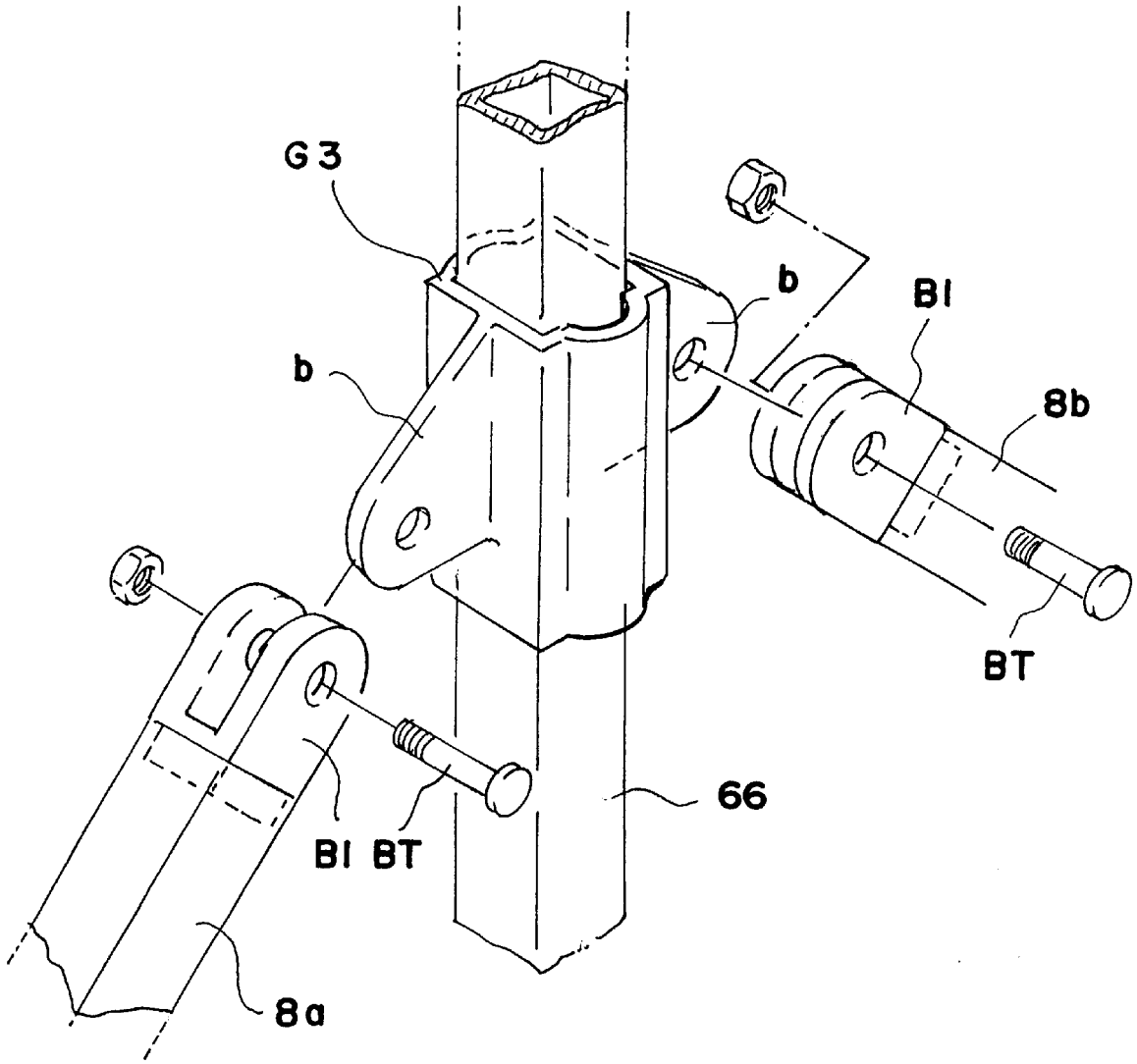
FIG. 25 is a perspective view showing a state in which brace end portions are mounted.

The state shown in FIG. 21 is an assembled state in a cubic form, in which the pipe struts 11 and 12 are placed upright on the ground. For folding the shoring from this state, the direction is changed by 90 degrees from the state shown in FIG. 21 and, for example, the fixed frame 1 is suspended from above, while the other fixed frame 2 is placed on the ground, in the same manner as in FIG. 11. In this state, the pin P is pulled out of the guide G3 and then the support rod 66 is pulled laterally through the hinge portion H1, in other words, the support rod 66 is pulled upward in FIG. 21, with the result that the support rod 66 slides within the guide G3. Consequently, as shown in FIG. 22, the baluster struts 5*a* turn on the brackets 100 and guide portion H1, and are folded upward. Likewise, the braces 8*a* and 8*b* turn in a direction of drawing near the support rod 66 through the brackets 101 and the brackets b. Further, the floor plates 20*a* and 20*b* are folded upward and at the same time the horizontal frames turn upward on the brackets 101 and the guide portion H2. Therefore, the pipe struts 11 and 12 approach each other into a compact shape. Other points relating to function and effect are the same as in the embodiment illustrated in FIG. 1.

The following effects are attained by the present invention.

1. According to the invention defined in claims 1 to 11, the reinforcing frames each comprise baluster struts, a support rod pivotally secured to the baluster struts, and four braces in oblique directions. The front ends of the braces are gathered and mounted to the support rod. Consequently, retaining force, strength and durability against vertical and transverse directions are improved to an extent sufficient to prevent deformation of the shoring even when a vertical load of a heavy object or a transverse compressive force based on vibration or the like acts on the shoring.
2. The four braces which constitute each auxiliary frame are each constituted by a single pillar body whose base ends are pivotally connected to pipe struts, while the front ends of the braces are merely connected to the support rod vertically movably. Thus, the structure of each reinforcing frame itself is simple. Therefore, the structure of the entire shoring can be simplified, the weight thereof can be reduced, the manufacture is easy, and the reduction of cost can be attained. Further, the folding work efficiency is improved and the tansport of the shoring can be done easily.
3. According to the invention defined in claim 12 there is attained a further effect of structural simplification in addition to the above effects because the number of braces used is only two.

What is claimed is:

1. A shoring comprising a pair of fixed frames opposed to each other and a pair of collapsible reinforcing frames disposed between both ends of said fixed frames, said reinforcing frames each comprising:

collapsible baluster struts whose base ends are pivotally connected between upper end portions of said fixed frames;

a support rod whose base end is pivotally connected to an intermediate position of said baluster struts and which is suspended downward;

first and second guides slidable on said support rod in opposite directions;

a pair of first braces, each of said first braces having one end pivotally connected to one of said upper end portions of said fixed frames and another end pivotally connected to said first guide;

a pair of second braces, each of said second braces having one end pivotally connected to one of said lower end portions of said fixed frames and another end pivotally connected to said second guide.

2. The shoring according to claim 1, wherein one or a plurality of the reinforcing frames are disposed vertically between both end portions of the paired fixed frames.

3. The shoring according to claim 1, wherein a plurality of the reinforcing frames are disposed vertically between both end portions of the paired fixed frames, and the support rod as a constituent of each said reinforcing frame is formed in one united body.

4. The shoring according to claim 1, wherein a horizontal brace comprising reinforcing braces which cross in an X shape, and sockets mounted at end portions of the reinforcing braces and having an inverted U-shaped section are provided, said horizontal brace being hooked detachably to the upper ends of the fixed frames through sockets.

5. The shoring according to claim 1, wherein sockets are formed on top of end portions of the fixed frames, and another auxiliary shoring unit in a shape of a rectangular parallelepiped or a cube is mounted contiguously onto the fixed frames and the reinforcing frames through the sockets.

6. The shoring according to claim 1, wherein sockets are formed at the lower ends of the fixed frames and another auxiliary shoring unit in a shape of a rectangular parallelepiped or a cube is mounted under the fixed frames and the reinforcing frames through said sockets, and further, jacks capable of being adjusted in their height are connected to lower comers of said auxiliary shoring unit and reinforcing braces are mounted between the adjacent jacks.

7. The shoring according to claim 5 wherein scaffolding boards projecting horizontally are attached detachably to the outer periphery of the auxiliary shoring unit mounted contiguously onto the fixed frames and the reinforcing frames.

8. The shoring according to claim 1, wherein brackets are formed projectingly on side faces of base ends of the fixed frames and another shoring is connected detachably to said shoring through connecting braces connected to said brackets.

9. A shoring comprising a pair of fixed frames opposed to each other and a pair of collapsible reinforcing frames disposed between both ends of said fixed frames, said reinforcing frames each comprising:

collapsible baluster struts whose base ends are pivotally connected between upper end portions of said fixed frames;

a support rod whose base end is pivotally connected to an intermediate position of said baluster struts and which is suspended downward; and four braces whose base ends are pivotally secured to upper and lower ends of said fixed frames and whose front ends are connected to said support rod vertically movably;

the support rod being formed by a channel steel having a vertical guide channel, a first guide being fitted vertically movably on a back of said channel steel, a second guide being fitted vertically movably in said guide channel, and either front ends oftwo upper said braces or front ends of two lower said braces are pivotally connected to one of said first and second guides.

10. The shoring according to claim 1, wherein the fixed frame comprises a pair of hollow side pipe struts standing up in parallel with each other, a fixed baluster strut mounted horizontally between said side pipe struts, four diagonal members whose base ends are connected to the upper and lower portions of the side pipe struts, and a bracket to which the front ends of said diagonal members are gathered and connected.

11. A shoring comprising a pair of fixed frames opposed to each other and a pair of collapsible reinforcing frames disposed between both ends of said fixed frames, said reinforcing frames each comprising:

collapsible baluster struts whose base ends are pivotally connected between upper end portions of said fixed frames;

collapsible horizontal support frames whose base ends are pivotally connected between lower end portions of said fixed frames and which are in parallel with said baluster struts;

a support rod hinged between an intermediate position of said baluster struts and an intermediate position of said horizontal support frames;

a guide fitted vertically slidably on the outer periphery of the upper portion of said support rod; and two braces hinged between both sides of said guide and the lower ends of said fixed frames.

12. The shoring in accordance with claim 11, wherein:

said pair of baluster struts, said support frames, said guide, and said braces are formed to have said braces move toward a position parallel with said fixed frames when said fixed frames are moved toward each other while maintaining a length of said braces substantially constant.

13. The shoring according to claim 9 wherein the first guide comprises a first slider which embraces the back of the channel steel and which is movable vertically and a support piece attached to said first slider, the second guide comprises a second slider fitted vertically movably in said guide channel and a bracket mounted to said second slider, and the front ends of braces are pivotally connected to both ends of said support piece and both ends of said bracket.

14. A shoring comprising:

a pair of fixed frames spaced from each other, each of said frames including a first and second end;

a pair of baluster struts, each of said baluster struts having a first end pivotally connected to one of said first ends of said fixed frames;

a support rod having one end pivotally connected to said second ends of said baluster struts;

a first guide slidable on said support rod;

a second guide slidable on said support rod independently of said first slide and in opposite directions from said first guide;

a pair of first braces, each of said first braces having one end pivotally connected to one of said first ends of said fixed frames and another end pivotally connected to said first guide;

a pair of second braces, each of said second braces having one end pivotally connected to one of said second ends of said fixed frames and another end pivotally connected to said second guide.

15. The shoring in accordance with claim 14, wherein:

said pair of baluster struts, said support rod, said first and second guide, and said pairs of first and second braces are formed to have said first and second guides slide in opposite directions on said support rod when said first and second fixed frames are moved toward each other.

* * * * *